US005441027A

United States Patent [19]

Buchanon et al.

[11] Patent Number: 5,441,027

[45] Date of Patent: Aug. 15, 1995

[54] INDIVIDUAL TIMING AND INJECTION FUEL METERING SYSTEM

[75] Inventors: David L. Buchanon, Westport; Lester L. Peters, Columbus; Julius P. Perr, Columbus; Yul J. Tarr, Columbus, all of Ind.

[73] Assignee: Cummins Engine Company, Inc., Columbus, Ind.

[21] Appl. No.: 208,365

[22] Filed: Mar. 10, 1994

Related U.S. Application Data

[63] Continuation-in-part of Ser. No. 65,583, May 24, 1993, abandoned.

[51] Int. Cl.[6] ..... F02M 57/02; F02M 59/36

[52] U.S. Cl. ..... 123/446; 123/456; 123/500; 123/510

[58] Field of Search ..... 123/446, 502, 456, 500, 123/501, 510, 481

[56] References Cited

U.S. PATENT DOCUMENTS

| | | | |
|---|---|---|---|
| 3,951,117 | 4/1976 | Perr | 123/446 |
| 4,249,499 | 2/1981 | Perr | 123/502 |
| 4,258,674 | 3/1981 | Wolff | 123/446 |
| 4,281,792 | 8/1991 | Sisson et al. | 123/502 |
| 4,343,280 | 8/1982 | Luscomb | 123/459 |
| 4,392,612 | 6/1983 | Deckard et al. | 239/88 |
| 4,407,251 | 10/1983 | Nakanishi | 123/472 |
| 4,410,138 | 10/1983 | Peters et al. | 239/95 |
| 4,459,963 | 7/1984 | Gross et al. | 123/506 |
| 4,479,475 | 10/1984 | Babitzka | 123/446 |
| 4,489,886 | 12/1984 | Kato | 239/88 |
| 4,531,672 | 7/1985 | Smith | 123/446 |
| 4,583,510 | 4/1986 | Schechter | 123/458 |
| 4,621,605 | 11/1986 | Carey, Jr. et al. | 123/446 |
| 4,971,016 | 11/1990 | Peters et al. | 123/500 |
| 5,042,445 | 8/1991 | Peters et al. | 123/446 |
| 5,168,855 | 12/1992 | Stone | 123/446 |
| 5,197,438 | 3/1993 | Yamamoto | 123/506 |
| 5,213,084 | 5/1993 | Linder et al. | 123/506 |
| 5,230,613 | 7/1993 | Hilsbus et al. | 123/456 |
| 5,245,970 | 9/1993 | Iwaszkiewicz et al. | 123/447 |
| 5,277,162 | 1/1994 | Smith et al. | 123/456 |
| 5,357,929 | 10/1994 | McCandless | 123/510 |

FOREIGN PATENT DOCUMENTS

| | | |
|---|---|---|
| 1522293 | 2/1967 | France . |
| 57-68532 | 4/1982 | Japan . |
| 2030222 | 4/1980 | United Kingdom . |

OTHER PUBLICATIONS

Patent Abstracts of Japan, Publication No. JP58131338, vol. 7, No. 244 "Fuel Supplying Apparatus for Diesel Engine", Aug. 1993.

Patent Abstracts of Japan, Publication No. JP57168051, vol. 7, No. 9 "Fuel Injection System", Oct. 1982.

*Primary Examiner*—Thomas N. Moulis

*Attorney, Agent, or Firm*—Sixbey, Friedman, Leedom & Ferguson

[57] ABSTRACT

A metering system is provided which controls the amount of fuel supplied to the combustion chambers of a multi-cylinder internal combustion engine comprising a fuel pump for supplying fuel at low pressure to a first and a second group of unit fuel injectors, a first solenoid-operated fuel control valve controlling the flow of fuel to the first set of injectors and a second solenoid-operated fuel control valve controlling the flow of fuel to the second set of injectors. The system may also include first and second solenoid-operated timing fluid control valves associated with the first and the second group of injectors, respectively. The injectors are capable of being in the fuel receiving mode, establishing a metering period, and the timing receiving mode, establishing a timing period, at the same time to increase the amount of time available for metering both timing fluid and fuel. By grouping the various injectors based on the order of injection so that the injectors from each group are placed in the injection mode in spaced periods throughout each cycle of the engine, e.g. injectors from other groups injecting in the period of time between each injection mode, the system can be designed to permit longer metering and timing periods.

36 Claims, 9 Drawing Sheets

CRANK ANGLE
480°
600°
0°
120°
240°
360°
480°
600°
INJECTOR NO. 1
INJECTOR NO. 3
INJECTOR NO. 2
INJECTOR NO. 5
INJECTOR NO. 6
INJECTOR NO. 4
3A
3B
3C
3D
METERING PERIODS FOR FIRST SET OF INJECTORS NOS. 1,3 & 2.
METERING PERIODS FOR SECOND SET OF INJECTORS NOS. 5,6 & 4.
INJECTION PERIODS

INDIVIDUAL TIMING AND INJECTION FUEL METERING SYSTEM

This Application is a Continuation-In-Part of Ser. No. 08/065,583, now abandoned, filed May 24, 1993.

TECHNICAL FIELD

BACKGROUND OF THE INVENTION

There is a continuing need for a simple, reliable, low cost yet high performance fuel injection system which can effectively and predictably control both fuel injection timing and metering. However, the design of such a fuel injection system necessarily involves acceptance of some characteristics which are less than optimal since the basic goals of low cost, high performance and reliability are often in direct conflict. For example, distributor-type fuel injector systems having a single centralized high pressure pump and a distributor valve for metering and timing fuel flow from the pump to each of a plurality of injection nozzles, such as disclosed in Japanese Application No. 57-68532 (Komatsu), are less expensive to construct than are other types of injection systems. However, distribution-type systems are not as reliable in operation as other types of systems due to unpredictable/uncontrollable behavior of high pressure fluids within the fluid line connecting the centralized high pressure fuel pump to the individual injector nozzles.

Many of the drawbacks associated with distributor-type systems can be overcome by providing an individual cam operated unit injector at each engine cylinder location, such as illustrated in U.S. Pat. No. 4,392,612, whereby only low pressure fuel needs to be supplied to each injector, since the high pressure necessary for injection can be supplied by the cam actuated pump located in each injector immediately adjacent the engine cylinder. Each injector also includes a control valve, e.g. solenoid valve, mounted on the injector body to control the amount of fuel injected into each cylinder. However, the requirement of an individual pump and control valve for each injector creates substantially higher manufacturing costs as compared with distributor-type systems. In addition, the unit injectors disclosed in U.S. Pat. No. 4,392,612, are designed so that each solenoid valve must close and open during a single injection stroke of the injector pump or plunger as the plunger moves inwardly to control the beginning and end of injection, respectively. Since each injection stroke of the plunger must occur in an extremely short period of time near the top dead center position of the corresponding engine piston as it completes the compression stroke and commences the power stroke, the design, operation and control of the solenoid valve becomes a critical, and often costly, consideration in the design of the unit fuel injector. In fact, it has been found that these types of unit injectors are not always capable of achieving predictable and effective control of the timing and metering of fuel injection over a wide range of operating conditions.

Commercially competitive fuel injector systems of the future will almost certainly need some capacity for controlling the timing of injection completely independent from the quantity in response to changing engine conditions in order to achieve acceptable pollution abatement and fuel efficiency. Certainly, some emission control standards will be difficult or impossible to meet unless both timing and quantity of fuel can be controlled extremely accurately on a cycle-by-cycle basis depending on operator demand and engine conditions. However, achieving the high degree of control required in high pressure distributor-type systems will be extremely difficult due to the high pressure waves transmitted through the high pressure lines connecting the distributor pump with the individual injectors. Likewise, although numerous attempts have been made to design a unit injector system which provides for variable timing and metering, a unit fuel injector system which is both economical and highly accurate has not yet been achieved.

U.S. Pat. Nos. 4,281,792 and 4,531,672, provide examples of attempts to solve this dilemma by disclosing unit fuel injectors which attempt to achieve independent control over injection timing and metering while minimizing the demands on the solenoid valve. The unit injector disclosed in U.S. Pat. No. 4,281,792 includes a two-part plunger having a variable volume hydraulic chamber separating the plunger sections and a single solenoid valve which commences the injection on the inward stroke of the plunger by closing to form a hydraulic link between the plunger sections. The point of closure can be varied to vary the point at which injection commences as illustrated by points B,C and D of FIGS. 8 and 9 of the '792 patent. Because points B,C and D are located on a rotatively steep portion of the cam surface, the point of closure of the control valve is quite time sensitive. On the outward stroke, the solenoid valve opens at a selected point to control the quantity of fuel metered for injection on the subsequent downstroke. The point of opening is illustrated by point E which may occur over a relatively less steeply sloped portion of the curve and such opening is less time sensitive. Therefore, this design eliminates the need for the solenoid to control both timing and metering in the relatively short time period of the inward stroke of the plunger. However, since the solenoid must still operate during the inward stroke to control timing and the inward stroke must occur over a relatively short time period (steep portion of cam profile) within the total cycle time of the engine piston, operating requirements for the solenoid and its associated circuitry still remain high.

U.S. Pat. No. 4,531,672 further minimizes the operating requirements of the solenoid valve by providing a unit injector which operates only on the outward stroke of the plunger, or during a dwell when the plunger is not moving, to control both timing and metering. As a result, a greater period of time, or window of opportunity, is provided within which the solenoid may operate. However, this fuel system, like the one disclosed in U.S. Pat. No. 4,281,792, does not entirely separate the timing and metering functions of each unit injector primarily because a single solenoid and associated supply passage serves both the metering and timing passages for each injector. As a result, the metering and timing phases can not occur at the same time. Consequently, the window of opportunity for metering corresponding to a single outward stroke of the plunger must be allocated between the metering and timing phases thereby undesirably decreasing the amount of time available for the completion of each phase. Moreover, within a given window of opportunity for metering, the single solenoid valve must be accurately controlled to open and then close with respect to the opening and closing of a supply or drain port by the plunger.

Unit injector systems such as those disclosed in U.S. Pat. Nos. 4,281,792 and 4,392,612 also suffer from the disadvantages inherent in systems having individual solenoid valves associated with each unit injector. Unlike a more conventional open nozzle unit injector, for example as disclosed in FIG. 16 of U.S. Pat. No. 3,951,117, which operates on pressure/time principles to control both metering and timing and therefore does not require a solenoid valve, these solenoid operated unit injectors require a solenoid valve for each injector resulting in a more complex and costly injector. In addition, the injector barrel must be forged to include a boss for receiving the solenoid valve body instead of using the simpler screw machining process for producing a symmetric injector body. Also, the boss and solenoid assembly extend into the cylinder head adjacent the injector restricting the space available for other engine components, such as the injector and valve drive train assemblies, while increasing the overall size of the engine. Lastly, many of these solenoid valves must be designed to withstand the extremely high pressures of the timing or metering fluids under compression by the injector plunger thus increasing the cost of the injector.

As mentioned above, the open nozzle fuel injector, such as disclosed in FIG. 16 of U.S. Pat. No. 3,951,117 and in FIG. 1 of U.S. Pat. Nos. 4,971,016 and 5,042,445, avoids the need for a solenoid valve since the amount of injection fuel and timing fluid metered to the injector is controlled by pressure-time metering, that is, the pressure of the fuel or fluid supplied to the injector through a precisely dimensioned feed orifice and the time period the plunger uncovers the feed orifice. However, this type of pressure-time control requires the fuel pressure to be constantly and accurately varied in response to changing engine conditions. To achieve this goal, many of these systems include pressure transducers in the supply lines to each injector for sensing the fuel supply pressure and providing feedback to the pressure controller thus adding to the overall cost of the fuel system. Moreover, open nozzle pressure-time fuel injector systems do not allow for individual cylinder control since fuel and timing fluid is constantly fed to each injector through a pressure regulator. In order to improve emissions and fuel economy, it is occasionally desirable to prevent one or more selected cylinders from providing power to the engine by stopping the injection of fuel into the combustion chamber by the injector corresponding to the particular cylinder or cylinders. However, this type of cylinder "cut out" is not practical with open nozzle, pressure-time, common rail injectors since a single injector cannot be easily isolated from the other injectors during operation of the engine.

Another problem associated with open nozzle pressure-time injectors is the inability of the injector to provide fast, positive response to fuel supply pressure changes. The amount of fuel metered is controlled at least in part by the fuel supply rail pressure which is varied depending on various engine conditions. When the fuel supply pressure is sharply decreased in response to changing engine conditions, it takes a period of time for the fuel pressure in the supply passage adjacent the injector to decrease to the new pressure level. This delay in response impedes the ability of the pressure-time metering control system to provide fast, accurate control of timing and metering.

Another problem commonly experienced in open nozzle pressure-time injectors is the presence of combustion gases in the supply passage between the supply port and the inlet check valve. Gases from the combustion chamber are pushed up into the supply passage by the engine piston. These gases interfere with the control of fuel metering and, therefore, must be removed. One attempt to remove the gases includes forming a scavenging flow passage in the supply side distinct from the supply or feed port for directing the gas containing supply fuel through the injector to drain creating a scavenging effect. However, such efforts to remove the gases have not always been completely successful. Similarly, the combustion gas or cylinder pressure may affect the amount of fuel metered in another way. The supply fuel must be metered against the cylinder pressure acting up through the metering chamber of the injector even though no gas actually travels to the fuel supply. At the relatively low fuel pressures necessary at low operating speeds and loads for efficient operation of open nozzle pressure-time injectors, the effects of cylinder pressure on fuel metering can be substantial resulting in yet another variable which must be considered before achieving accurate control of metering throughout the range of operating conditions.

Other fuel injection systems have been developed in an attempt to overcome some of the deficiencies discussed above while also attempting to achieve efficiency of combustion, fuel economy and emissions abatement. In order to achieve these goals, it is certain that the fuel supply system must be able to provide precisely controlled amounts of fuel and timing fluid to each injector at the precise time required in the injection cycle. U.S. Pat. No. 4,621,605 provides an example of such an attempt by disclosing a positive displacement fuel injection system which forms and delivers premetered slugs of fuel and timing fluid to unit injectors. This system is capable of varying the size of the fuel and timing slugs on a cycle-by-cycle basis without the use of individual solenoid valves and pressure-time metering. However, the system uses a complex fuel pump including a piston/chamber arrangement, variable position mechanical stop and a 3-way flow control valve for each fuel metering and timing fluid circuit. Consequently, the system is complicated, costly and impractical for many purposes. Moreover, the slug forming chambers are remote from each cylinder which adds line condition variables that are not necessarily controllable or predictable. In addition, since only one fuel metering and one timing control arrangement serve all injectors of the engine, each control arrangement must deliver, in the time period of a given engine cycle, a number of metered slugs corresponding to the total number of injectors in the engine. Therefore, the total time period of a complete cycle of the engine must be allocated into a number windows of opportunity for metering corresponding to the total number of injectors in the engine, e.g. six windows for a six cylinder engine. As a result, the window of opportunity for metering for each injector cannot be maximized in the total engine cycle time period and the operating requirements, e.g. response time, of the control arrangement must be very high.

As previously discussed, U.S. Pat. No. 4,531,672 to Smith discloses a unit fuel injector containing a fluid timing circuit and a fluid metering circuit for providing fuel flow to respective timing and metering chambers by means of a single solenoid valve which is adapted to control separately timing and metering through variation in the time of opening and closing, respectively, during each cycle of operation. While this type of injector design may provide adequate control over both timing and metering, it uses common metering and timing passages thereby requiring engine fuel to be used as the timing fluid..As a result, a greater amount of fuel is supplied to the unit injector than is necessary to supply the injection chamber since fuel is continually cycled through the timing chamber during injector operation. This results in a substantial amount of timing fuel being heated within the injector and subsequently drained or spilled to the fuel supply tank. The hot fuel returned to the supply tank causes undesired fuel evaporation and often requires the installation of fuel cooling heat exchangers to reduce the temperature of the fuel in the supply tank.

The problems associated with draining excessive quantities of hot fuel to the supply tank and the accompanying pressure spikes have become even more apparent due to recent and upcoming legislation placing strict emission standards on engine manufacturers resulting from a concern to improve fuel economy and reduce emissions. In order for new engines to meet these standards, it is necessary to produce fuel injectors and systems capable of achieving higher injection pressures, shorter injection durations and more accurate control of injection timing. High injection pressures may be achieved in a number of ways such as by varying the cam profile, plunger diameter and/or number and size of injection orifices. Various techniques have been developed to control timing including mechanical, e.g. racks for rotating injector plungers having helical control surfaces; electronic, e.g. valves for controlling the start and/or end of injection and hydraulic, e.g. variable length hydraulic links. With respect to the latter, timing is advanced by introducing more timing fluid into the timing chamber which effectively lengthens the fluid link between the injector plungers. In the typical injector, as a result of this lengthened link, the pumping plunger commences injection and/or reaches its bottom most position at an earlier point in the rotation of the corresponding cam. Accordingly, fuel injection can occur at a point in the combustion cycle when the piston of the engine is still moving upward.

Because fuel is normally used as the timing fluid in injectors of this type, the amount of fuel which is supplied to and drained away from the injector of an engine necessarily increases as compared with injectors employing non-hydraulic timing control or no timing control. The amount of heat absorbed by the fuel and ultimately the temperature of the fuel in the fuel supply tank has been found to increase to an unacceptably high level.

Other fuel injector and fuel injection system designs which provide for variable timing and metering are disclosed in U.S. Pat. Nos. 4,249,499 to Perr and 4,410,138 to Peters et at. The unit injector design disclosed in the '499 Perr patent includes a timing mechanism having movable pistons connected between a cam drive and an injector plunger that allow timing fluid to enter a timing chamber to form a variable length hydraulic link between the pistons depending on the pressure of the supply wherein the length of the link determines the point at which injection is initiated. The timing fluid circuit, which preferably uses engine lubricant, is separate from the fuel supply or metering circuit. Therefore, since lube oil is used as a timing fluid in a separate timing circuit, the above-mentioned hot fuel drain problem is avoided in this design. However, this design controls injector timing using a variable pressure timing fluid mechanism, while fuel metering control is based on pressure-time metering. Consequently, both timing fluid pressure and metering fuel pressure are critical variables which must be carefully controlled for proper timing and metering. Precise control of fuel and fluid pressure to accurately and effectively control both fuel injection timing and metering over a wide range of operating conditions is often difficult to achieve.

U.S. Pat. No. 4,410,138 to Peters et al. discloses a fuel injector having infinitely variable timing using a two part injector plunger which forms a variable link timing chamber between the upper and lower plungers for receiving timing fluid. Here again, although the timing fluid circuit is completely separate from the fuel metering circuit, precise control of both the timing fluid pressure and metering fuel pressure are necessary for accurate and reliable control of timing and metering.

U.S. Pat. No. 5,143,291 to Grinsteiner discloses a unit fuel injector using high pressure lubricating oil to pressurize the fuel for injection. However, each fuel injector requires a separate solenoid valve for controlling the flow of lubricating oil resulting in a more complex and costly injector. Also, the lubricating oil enters each injection at high pressure and is not compressed in a timing chamber by an engine-operated timing plunger. Therefore, the lubricating oil in each injector does not experience temperature increases associated with the high compression of timing fluid in injectors having mechanically driven pump plungers.

Another important concern accentuated by higher injection pressures is the need to adequately cool unit injectors during operation. In the fuel injector design disclosed in U.S. Pat. No. 4,531,672 to Smith, both the metering fuel and the timing fuel inherently function to cool the unit injector. However, it has been discovered that when fuel is used as the timing fluid, excessive heat may be absorbed by the fuel resulting in the fuel assuming an unacceptably high temperature over extended periods of engine operation. Thus, in order to ensure adequate cooling of the injector, the fuel in the fuel supply tank must be cooled using expensive coolers.

Another important requirement of fuel injectors using engine fuel as timing fluid is to provide a leak off passage between the uppermost plunger and the rocker arm or driving assembly. Without such a leak off passage, fuel leakage by the uppermost plunger would cause the fuel to be mixed with the engine lubrication oil supplied to the rocker arm and linkage assembly impairing the lubrication qualities of the lube oil and ultimately increasing engine wear.

Consequently, there is a need for a simple, reliable, low cost yet high performance fuel injection system which can effectively and predictably control both fuel injection timing and metering by maximizing the time period available for metering of fuel and timing fluid. There is also a need for such a fuel injection system which can effectively and predictably control both fuel injection timing and metering while adequately cooling the injector internals without causing excessive heating of the engine fuel.

SUMMARY OF THE INVENTION

It is an object of the invention, therefore, to overcome the disadvantages of the prior art and to provide an injection fuel and timing fluid metering system capable of effectively and predictably controlling both fuel injection timing and metering.

It is another object of the present invention to provide a metering system which minimizes the number of control valves used to control metering while providing a greater time period, for each injector, during which timing fluid and injection fuel metering may occur.

It is yet another object of the present invention to provide a metering system which minimizes the operating requirements of the control valves used in the metering system.

It is a further object of the present invention to provide a metering system which permits timing fluid metering and injection fuel metering to occur simultaneously.

It is a still further object of the present invention is to provide a metering system which eliminates the need for the control valves to operate to control metering during the relatively short timing period of the inward stroke of the injector plunger.

Still another object of the present invention is to provide a metering system which does not require the control valves to be accurately controlled to open and close with respect to the opening and closing of a supply or drain port by the plunger.

Yet another object of the present invention is to provide a metering system which eliminates the need for a control valve for each injector while still providing individual cylinder control and cutout.

A still further object of the present invention is to provide a metering system which decreases the sensitivity of the metering system on the fluid supply pressure while providing fast, positive response to fuel supply pressure changes.

It is yet another object of the present invention is to provide a metering system which eliminates the need for a scavenging flow passage in each injector to remove combustion gas the supply fuel.

It is a further object of the present invention to provide a metering system which minimizes the effects of cylinder pressure on fuel metering.

It is another object of the present invention to provide a fuel injection system using lubrication oil as timing fluid to effectively cool and lubricate the fuel injectors without causing excessive heating of the engine's fuel.

It is yet another object of the present invention to provide a fuel injection system which minimizes both the amount of fuel required by the injectors and the amount of heated fuel returned to the fuel supply tank from the injectors.

These and other objects are achieved by providing a metering system for controlling the amount of fuel supplied to the combustion chambers of a multi-cylinder internal combustion engine comprising a fuel pump for supplying fuel at low pressure to a first and a second group of unit fuel injectors via first and second fuel supply paths, respectively. A first solenoid-operated fuel control valve positioned in the first fuel supply path between the fuel pump and the first set of injectors controls the flow of fuel to the first set of injectors while a second solenoid-operated fuel control valve positioned in the second fuel supply path between the fuel pump and the second set of injectors controls the flow of fuel to the second set of injectors. Only one injector from the first group and one injector from the second group of injectors can be placed in a mode for receiving fuel from the fuel pump at any given time during the operation of the engine thereby allowing the metering of each injector to be independently controlled over a greater time period. The system may also include a first solenoid-operated timing fluid control valve positioned in a first timing fluid supply path associated with the first group of injectors and second solenoid-operated timing fluid control valve positioned in a second timing fluid supply path associated with the second group of injectors wherein at any given time only one injector from the first group and one injector from the second group of injectors can be placed in a timing fluid receiving mode. The injectors are capable of being in the fuel receiving mode, establishing a metering period, and the timing receiving mode, establishing a timing period, at the same time to increase the amount of time available for metering both timing fluid and fuel. By grouping the various injectors based on the order of injection so that the injectors from each group are placed in the injection mode in spaced periods throughout each cycle of the engine, e.g. injectors from other groups injecting in the period of time between each injection mode, the system can be designed to permit longer metering and timing periods.

The unit injectors may include an injector body having an injection orifice at one end and a cavity communicating with the orifice and containing inner and outer plunger sections arranged to form a variable volume metering chamber between the inner plunger and the orifice for receiving fuel during the metering period and a variable volume timing chamber between the inner and outer plungers for receiving timing fluid during the timing period. The solenoid-operated valves are moved between open and closed positions during the metering and timing periods to allow fuel and timing fluid, respectively, to flow to the metering and timing chambers thereby defining metering and timing events, respectively. The metering and timing events for each injector occur only between periodic, relatively quick injection strokes of the plungers .thereby minimizing the operating response time requirements of the control valves. The fuel supply passage to the metering chamber of each injector contains a spring-loaded check valve for preventing the flow of fuel out of the metering chamber while also preventing combustion gases from entering the supply passage and disturbing the effective control of metering. The injectors may be either open or closed nozzle injectors. A pressure regulator maintains the pressure in the timing fluid and fuel supply paths at a substantially constant pressure. Also, flow control valves may be provided downstream of the fuel pump to provide a fixed flow rate independent of fuel pressures upstream and downstream of the flow control valves.

The plungers of the injectors may be reciprocated by a cam driven by the engine. Alternatively, a hydraulic intensification system may be used by providing a timing fluid control valve for each injector which provides very high pressure timing fluid to a timing chamber positioned adjacent the plunger to permit the pressure of the timing fluid acting on the plunger to force the plunger inwardly causing injection of the fuel in the metering chamber.

DETAILED DESCRIPTION OF THE PREFERRED EMBODIMENT

Throughout this application, the words "inward", "innermost", "outward" and "outermost" will correspond to the directions, respectfully, toward and away from the point at which fuel from an injector is actually injected into the combustion chamber of an engine. The words "upper" and "lower" will refer to the portions of the injector assembly which are, respectively, farthest away and closest to the engine cylinder when the injector is operatively mounted on the engine.

Figure 1:
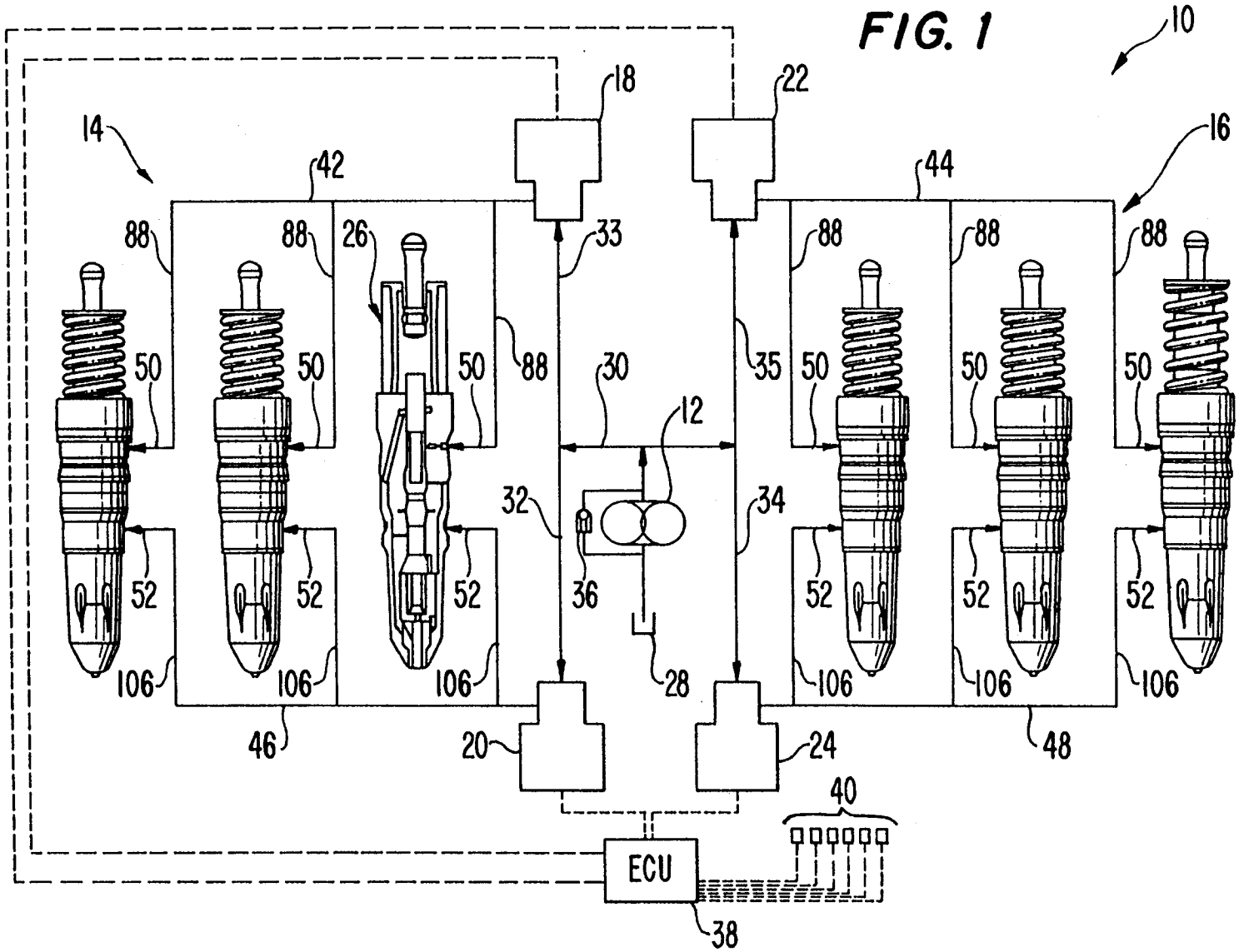
FIG. 1 is a schematic view of the preferred embodiment of the individual timing and fuel injection metering system of the present invention.

Referring to FIG. 1, there is shown a timing fluid and injection fuel metering system 10 of the present invention as applied to a six-cylinder 5 engine (not shown) having one injector associated with each cylinder. Generally, the metering system 10 includes a fuel supply pump 12 for supplying low pressure fuel both to a first set of unit fuel injectors 14 via a timing fluid control valve 18 and an injection fuel control valve 20 and to a second set of unit fuel injectors 16 via a timing fluid control valve 22 and an injection fuel control valve 24. Each fuel injector 26 of each set of injectors 14, 16 is operable to create a timing period and a metering period within which the control valves 18, 20, 22, 24 operate to define the amount of timing fluid and injection fuel, respectively, metered to the injector. By providing separate timing and metering circuits controlled individually by a respective control valve, the metering system can effectively and predictably control both fuel injection timing and metering at the same time during the metering stroke of the injector plunger thereby maximizing the time period or window of opportunity available for metering of fuel and timing fluid. Moreover, the metering system maximizes the time period for metering for each injector of a particular set of injectors by selectively grouping the injectors with respect to the sequence of injection periods of the entire bank of injectors to allow the metering and timing periods of a specific group to be spread throughout the total cycle time of the engine.

Fuel supply pump 12 is a gear pump which draws fuel from a reservoir 28 and directs it to a common supply passage 30. Supply passage 30 supplies fuel to both a first fuel supply path 32 and a second fuel supply path 34 providing fuel for injection to the first and second set of injectors 14, 16 respectively. Supply passage 30 also supplies fuel to both a first timing fluid supply path 33 and a second timing fluid supply path 35 providing fuel, as timing fluid, to the first and second set of injectors 14, 16 respectively. A bypass valve 36 positioned in a bypass line of supply pump 12 maintains the fuel supply at a substantially constant pressure which is preferably between 100 and 500 psi. Bypass valve 36 is spring biased to open at a predetermined downstream fuel pressure to allow fuel from the outlet side of pump 12 to flow through the bypass line to the inlet side of pump 12 thereby maintaining the supply fuel pressure at the predetermined level.

The timing fluid control valves 18, 22 and injection fuel control valves 20, 24 are positioned in the respective timing fluid supply paths 33, 35 and fuel supply paths 32, 34 to control the flow of timing fluid and injection fuel to the respective injectors. The control valves 18, 20, 22, 24 are each of the electromagnetic or solenoid-operated type valve assemblies having valve elements operable between open and closed positions to control the flow of timing fluid and fuel from the supply paths 32, 33, 34, 35 to the injectors. The control valves 18, 20, 22, 24 are controlled by an electronic control unit (ECU) 38 which receives signals such as engine speed and position, accelerator pedal position, coolant temperature, manifold pressure and intake air temperature signals from corresponding engine sensors indicated generally at 40. On the basis of these signals, the ECU 38 judges the engine operating condition and emits control signals to the control valves 18, 20, 22, 24 such that the fuel injection timing and the amount of fuel to be injected through each injector 26 are optimized for the engine operating condition.

First timing fluid control valve 18 and second timing fluid control valve 22 deliver fuel into respective timing fluid common rail portions 42, 44 of the respective first and second timing fluid supply paths 33, 35. Likewise, first and second injection fuel control valves 20, 24 control the flow of fuel to respective first and second injection fuel common rail portions 46, 48 of the respective first and second fuel supply paths 32, 34. Each injector 26 includes a timing circuit 50 for receiving timing fluid from timing fluid common rail 42, 44 and a metering circuit 52 for directing fuel from common rail portions 46, 48 into the injector for subsequent injection into the corresponding cylinder of the engine.

Figure 2:
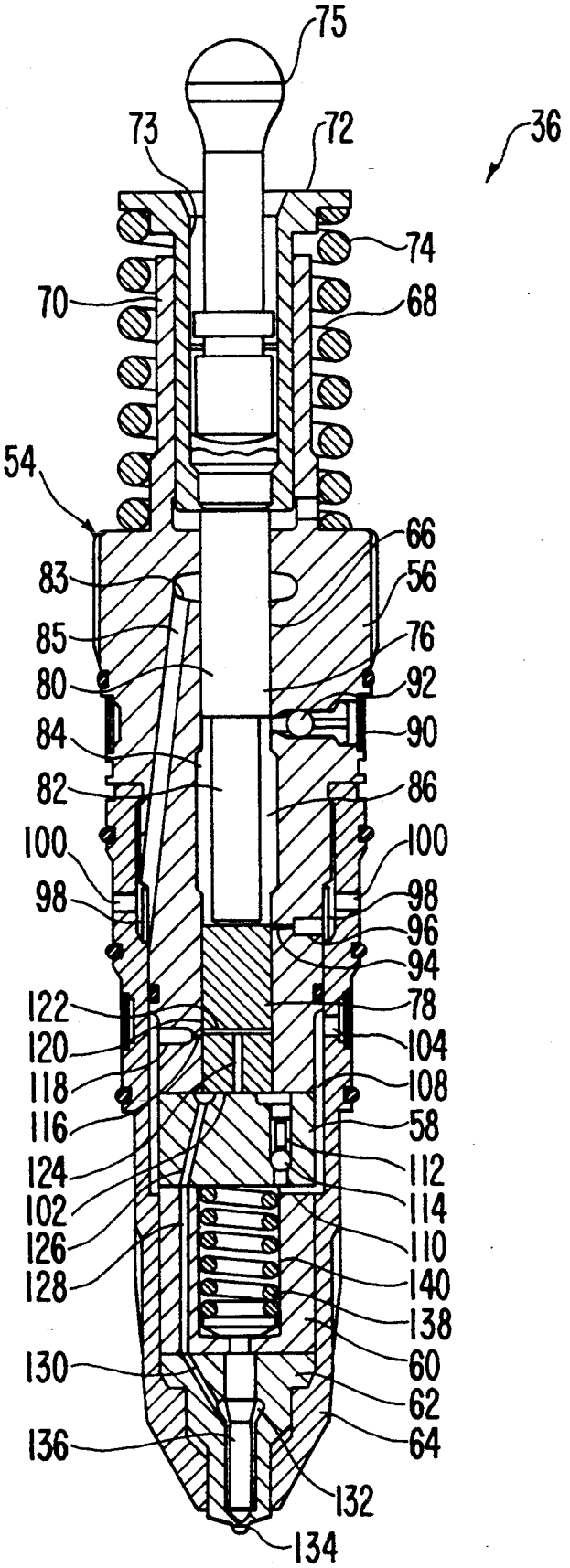
FIG. 2 is a cross-sectional view of a closed nozzle unit injector used in the metering system of FIG. 1 showing the plungers of the injector in their respective innermost positions prior to being placed in a fuel receiving mode.

The types of injectors which may be used in the present timing fluid and fuel metering system will now be described in detail. Referring to FIG. 2, there is shown a closed nozzle unit fuel injector 36 which includes an injector body 54 formed from an outer barrel 56, a spacer 58, a spring housing 60, a nozzle housing 62 and a retainer 64. The spacer 58, spring housing 60 and nozzle housing 62 are held in a compressive abutting relationship in the interior of retainer 64 by outer barrel 56. The outer end of retainer 64 contains internal threads for engaging corresponding external threads on the lower end of outer barrel 56 to permit the entire unit injector body 54 to be held together by simple relative rotation of retainer 64 with respect to outer barrel 56.

Outer barrel 56 includes a plunger cavity 66 which opens into a larger upper cavity 68 formed in an upper extension 70 of outer barrel 56. A coupling 72 is slidably mounted in upper cavity 68 and includes a cavity 73 for receiving a link 75. Coupling 72 and link 74 provide a reciprocable connection between the injector and a driving cam (not shown) of the engine. A coupling spring 74 is positioned around extension 72 to provide an upward bias against coupling 72 to force link 75 against the injector drive train and corresponding cam (not shown). The drive train may include a rocker assembly for connecting link 75 to the cam.

Plunger cavity 66 extends longitudinally through outer barrel 56 for receiving both an outer timing plunger 76 and an inner metering plunger 78. Timing plunger 76 includes an upper portion 80 having an outer diameter which permits upper portion 80 to slidably engage plunger cavity 66 while substantially preventing fuel leakage between upper portion 80 and plunger cavity 66. Any fuel leaking by upper portion 80 is collected in an annular groove 83 and directed into a drain passage 85 communicating with groove 83. A lower portion 82 formed on the inner end of upper portion 80 extends inwardly towards spacer 58. Lower portion 82 has a smaller diameter than plunger cavity 66 and upper portion 80 to form an annular cavity 84. The outermost end of timing plunger 76 contacts the innermost end of link 73 to cause timing plunger 76 to move in response to cam rotation. The innermost end of inner portion 82 of timing plunger 76 together with the outermost end of metering plunger 78 forms a timing chamber 86 for receiving timing fluid from the particular timing fluid control valve 18, 22 associated with the set of injectors to which the injector belongs.

Timing circuit 50 provides both a delivery and a spill path for the timing fluid during each injection cycle. Timing circuit 50 includes a branch passage 88 (shown in FIG. 1), timing chamber 86 and various supply and spill passages which will now be described in greater detail. Timing fluid is provided to timing chamber 86 from timing fluid common rail portion 42 by branch passage 88 and a supply port 90 formed in outer barrel 56 and extending radially from timing chamber 86. A spring biased inlet ball check valve 92 positioned in supply port 90 prevents timing fluid from flowing from timing chamber 86 through supply port 90 while allowing timing fluid to pass into timing chamber 86.

Outer barrel 56 includes a timing spill orifice 94 and a timing spill port 96 extending radially from cavity 66. Timing spill orifice 94 and spill port 96 provide communication between timing chamber 86 and annular timing fluid spill channel 98 formed between outer barrel 56 and retainer 64. Timing fluid drain ports 100 are provided in retainer 64 adjacent annular channel 98 to allow timing fluid to flow from annular channel 98 to a timing fluid drain system which is fluidly connected with that portion of the injector cavity (not illustrated) formed in the cylinder head of the engine adjacent timing fluid drain ports 100.

Fuel metering circuit 52 is formed to provide both a delivery and spill path for the metering fuel during each cycle of the engine. Fuel metering circuit 52 includes a metering chamber 102 and various supply and spill passages which will now be described in greater detail. As shown in FIG. 2, metering chamber 102 is formed between the innermost end of metering plunger 78 and spacer 58. Metering chamber 102 receives fuel from a fuel supply port 104 formed in retainer 64 which communicates with a branch passage 106 (shown in FIG. 1 ). Fuel flows through supply port 104 into an annular channel 108 formed between the lower portion of outer barrel 56 and retainer 64. Annular channel 108 continues inwardly between spacer 58 and retainer 64 to connect with a radial passage formed in the upper surface of spring housing 60. An inlet passage 112 extends through spacer 58 connecting radial passage 110 with metering chamber 102. A spring loaded ball check valve 114 positioned in fuel inlet passage 112 permits passage of fuel at a predetermined pressure from fuel supply port 104 to metering chamber 102 while preventing fuel flow from metering chamber 102 through fuel inlet passage 112. A metering spill orifice 116 and metering spill port 118 formed in the lower end of outer barrel 56 extend radially from cavity 66 adjacent metering plunger 78 to communicate with annular channel 108. Metering plunger 78 includes an annular groove 120, a radial passage 122 and an axial passage 124 in communication with each other to permit fuel to flow from the metering chamber 102 to metering spill orifice 116 and spill port 118 depending on the position of metering plunger 78 during the operation of the injector as discussed in more detail hereinbelow.

Spacer 58 also includes a fuel transfer passage 126 fluidically communicating metering chamber 102 with a fuel passage 128 formed in spring housing 60. Nozzle housing 62 includes a fuel passage 130 for directing fuel from passage 128 to a nozzle cavity 132 formed in nozzle housing 62. As illustrated in FIG. 2, nozzle housing 62 also includes injector orifices 134 which are normally closed by an axially slidable pressure actuated tip valve element 136 mounted in nozzle cavity 132. A spring 138 positioned in a central bore 140 formed in spring housing 60 biases tip valve element 136 into the closed position blocking injector orifices 134. When the pressure of fuel within nozzle cavity 132 exceeds a predetermined level, tip valve element 136 moves outwardly against the biasing force of spring 138 to allow fuel to pass through the injector orifices 134 into the combustion chamber (not shown).

Figure 3A:
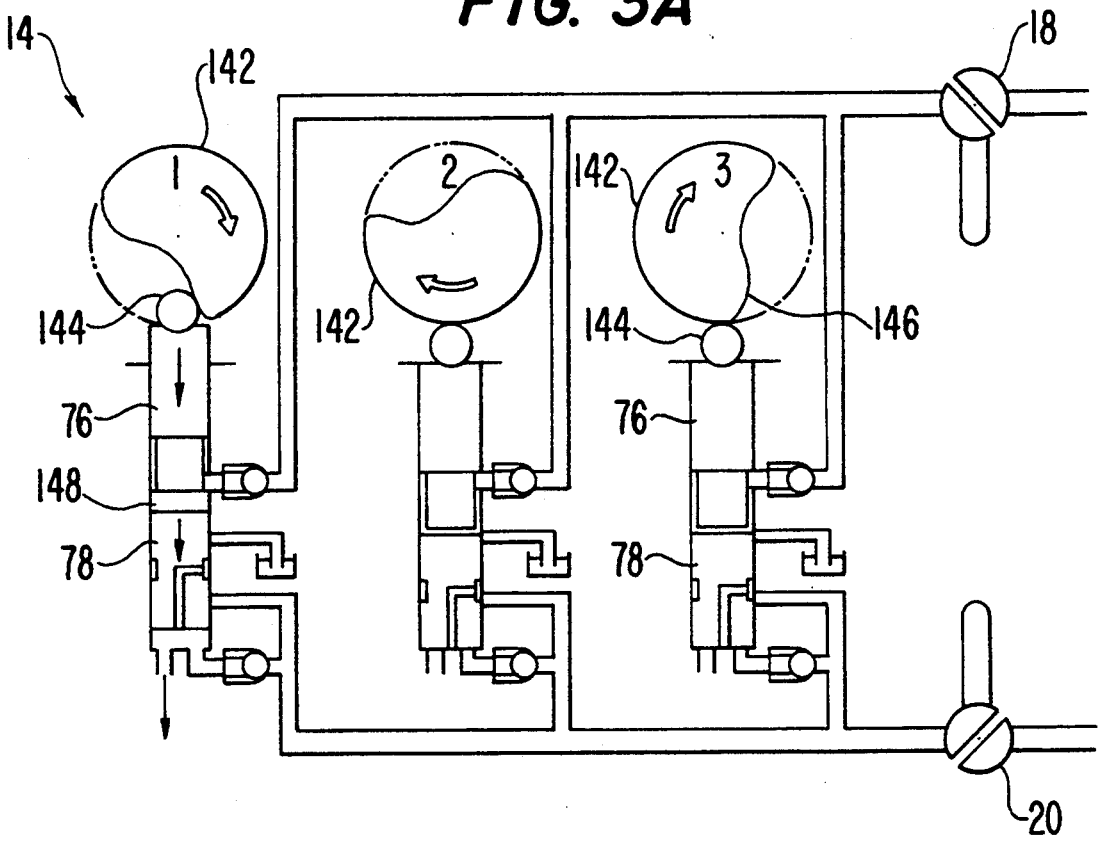
FIG. 3A is a cross-sectional schematic view portion of the metering system of FIG. 1 showing a first set of unit injectors with a pair of fuel injection and timing fluid control valves and associated supply passages showing the plunger positions of the respective unit injectors with the engine crank angle at 0°.
Figure 3B:
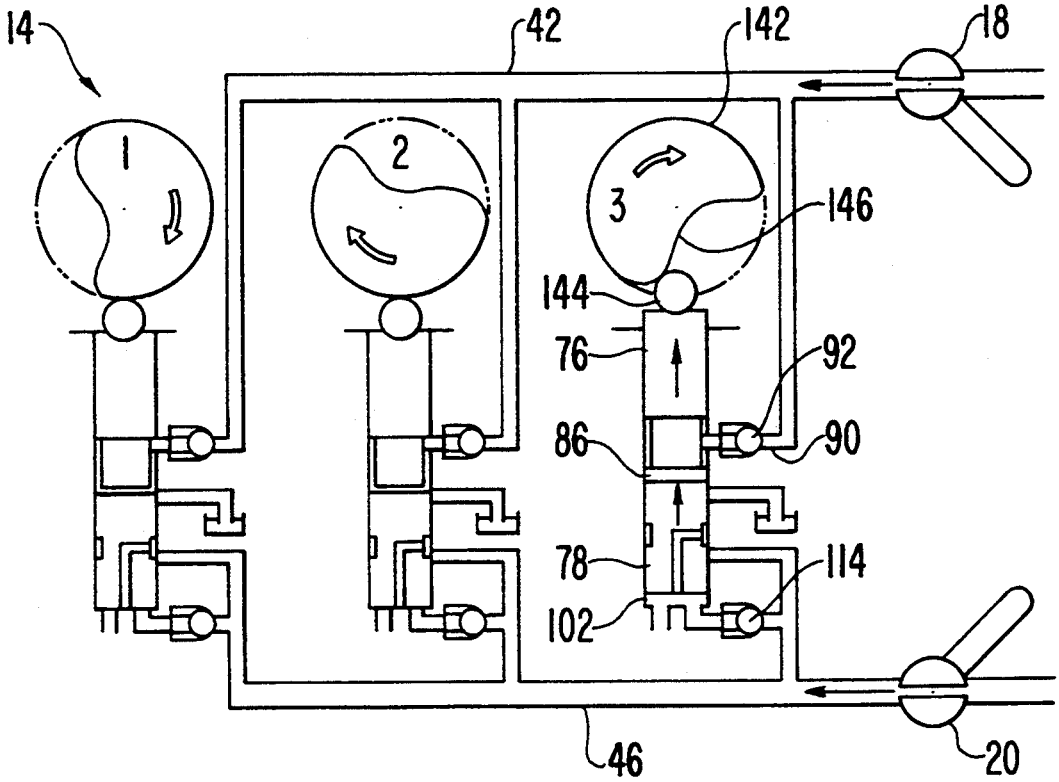
FIG. 3B is a cross-sectional schematic of the FIG. 3A metering system showing the plunger positions of the respective unit injectors with the engine crank angle at 80°.
Figure 3C:
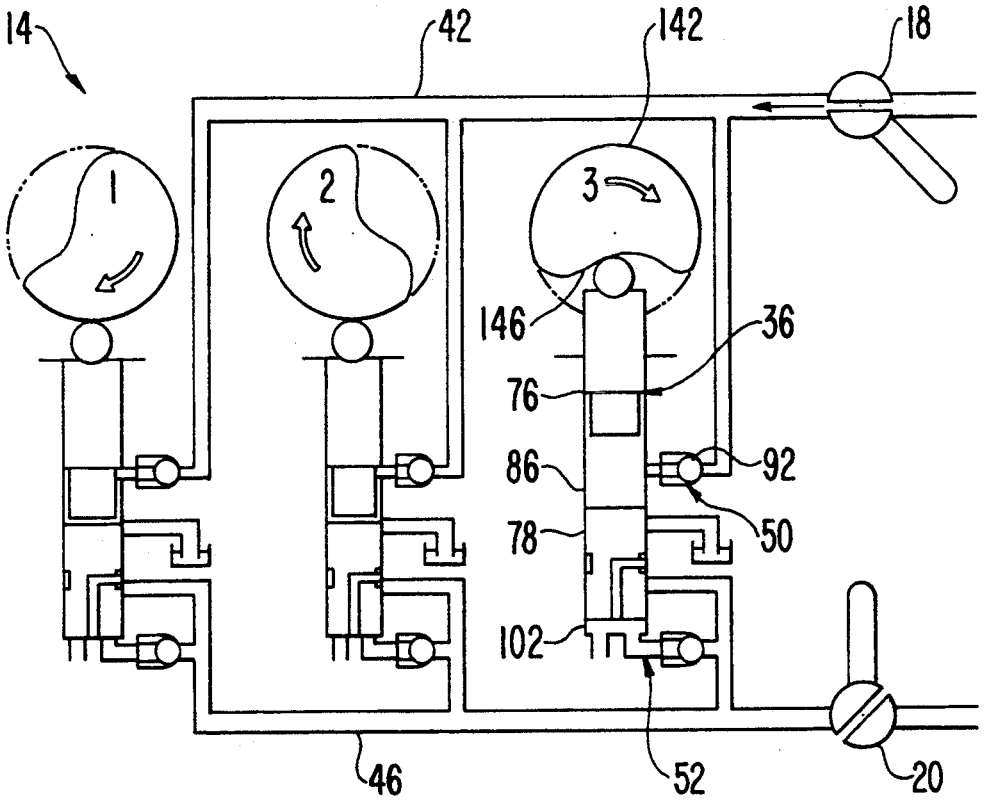
FIG. 3C is a cross-sectional schematic of the FIG. 3A metering system showing the plunger positions of the respective unit injectors with the engine crank angle at 160°.
Figure 3D:
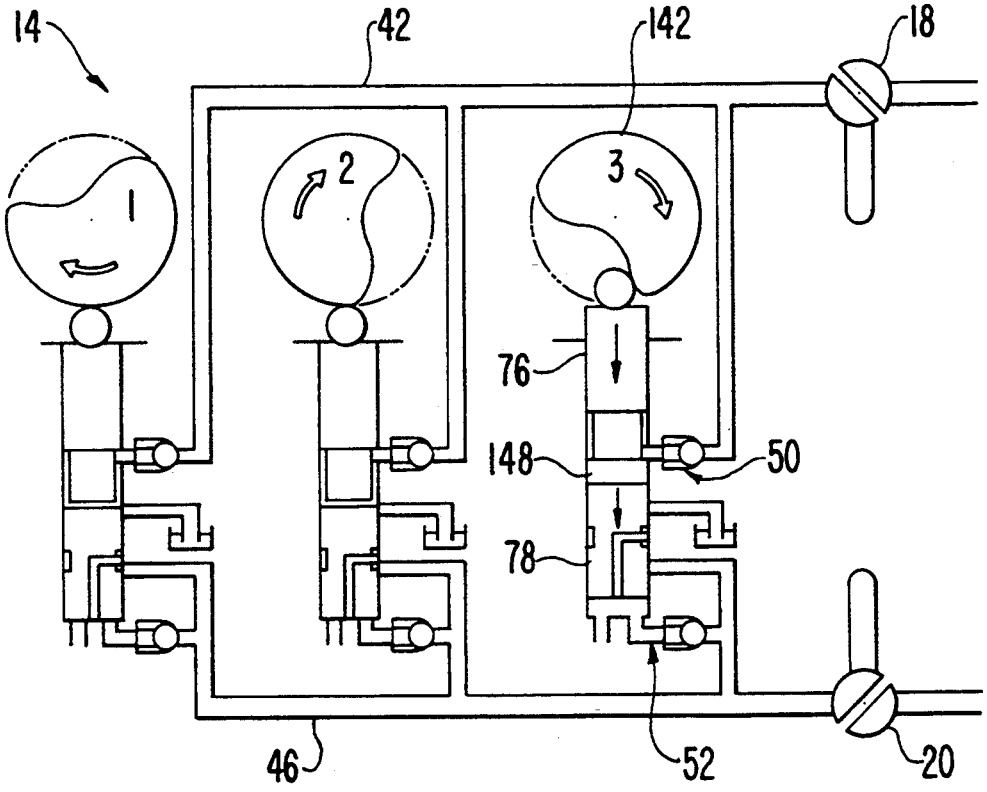
FIG. 3D is a cross-sectional schematic of the FIG. 3A metering system showing the plunger positions of the respective unit injectors with the engine crank angle at 240°.

The operation of closed nozzle fuel injector 36 will now be described with reference to FIGS. 1, 2 and 3A–3D. FIGS. 3A–3D illustrate the sequential operation of only the first set of unit fuel injectors 14 and control valves 18, 20. Also, FIGS. 3A–3D illustrate the closed nozzle fuel injector 36 of FIG. 2 in a more conceptual manner for ease of illustration and understanding of the operation of the entire system. Each injector will be referred to with the number corresponding to the cylinder to which it is associated. The plunger position of closed nozzle fuel injector 36 as shown in FIG. 2 corresponds to the plunger position of injector 3 of FIG. 3A. In FIGS. 3A–3D, timing plunger 76 of each of the respective injectors is operatively connected to a cam 142 via a roller 144 instead of link 75 of FIG. 2. When roller 144 or link 75 is positioned against the outer base circle of cam 142 as illustrated by injector 3 in FIG. 3A, timing plunger 76 and metering plunger 78 are positioned in their respective innermost positions or at bottom dead center. In this position, timing chamber 86 is in its shortest possible form since lower portion 82 of timing plunger 76 abuts metering plunger 78. Metering plunger 78 is positioned to uncover timing spill orifice 94 and spill port 96 allowing timing fluid to drain from timing chamber 86. Also, radial passage 122 and annular groove 120 are positioned to communicate with metering spill orifice 116 and spill port 118 allowing fuel to spill from axial passage 124, transfer passage 126, passage 128, passage 130 and cavity 132 into annular channel 108. The entire time roller 144 moves along the outer base circle of cam 142, plungers 76, 78 are in the innermost position and, therefore, no timing fluid and no fuel can be effectively metered into the timing chamber 86 and metering chamber 102, respectively. As shown in FIG. 3B, once cam 142 rotates to allow roller 144 to move onto a ramp portion 146, coupling spring 74 forces roller 144 and timing plunger 76 outwardly as dictated by the profile of ramp portion 146 of cam 144. The movement of plunger 76 outwardly marks the beginning of a timing period and a metering period during which timing fluid control valve 18 and injection fuel control valve 20 may be operated to meter timing fluid and injection fuel into the respective chambers. As shown in FIG. 3B, timing fluid control valve 18 is operated to an open position by a signal from ECU 38 based on engine operating conditions to allow fuel to enter timing chamber 86 via common rail portion 42, timing circuit 50, supply port 90 and check valve 92 thus beginning a timing fluid metering event. Injection fuel control valve 20 is also operated to an open position by a signal from ECU 38 to allow fuel to flow from supply path 32 into common rail portion 46 for delivery to metering chamber 102 via metering circuit 52 thus beginning a fuel metering event. Specifically, injection fuel flows into fuel supply port 104 and annular channel 108, through radial passage 110 and upwardly into supply passage 112. Fuel is maintained at a pressure high enough to overcome the spring pressure of check valve 114 thereby allowing fuel to flow through supply passage 112 into metering chamber 102. The pressure of the injection fuel entering metering chamber 102 forces metering plunger 78 outwardly toward timing chamber 86 closing off timing spill orifice 94 and metering spill orifice 116. Once the proper amount of injection fuel is metered into metering chamber 102 as dictated by engine operating conditions, ECU 38 delivers a signal closing injection fuel control valve 20 thus ending the fuel metering event and stopping the outward movement of metering plunger 78 as shown in FIG. 3C. At some point while the timing plunger 76 continues to move outwardly,.ECU 38 will deliver a closing signal to timing fluid control valve 18 causing valve 18 to move to a closed position stopping the flow of timing fluid to timing circuit 50 thereby ending the timing fluid metering event as shown in FIG. 3D. Termination of the outward movement of timing plunger 76 as determined by the profile of cam 144, marks the end of both the timing and metering periods. As cam 144 of injector 3 continues to rotate, ramped portion 146 forces timing plunger 76 inwardly through an injection stroke placing unit injector 36 in an injection mode in which fluid flow from supply paths 33, 32 through both timing circuit 50 and metering circuit 52 to respective timing and metering chambers 86, 102 is blocked by valves 18, 20 for producing the injection of fuel in metering chamber 102 through injection orifice 134. As timing plunger 76 moves inwardly, a timing fluid link 148 is formed between timing plunger 76 and metering plunger 78 in order to advance or retard the timing of fuel injection. The length of fluid link 148 and, therefore, the degree of advancement or retardation of injection timing, is controlled by the mount of timing fluid permitted to enter timing chamber 86 during the timing period. Since the pressure of the timing fluid is maintained at a substantially constant level, the amount of timing fluid metered to timing chamber 86 is primarily dependent on the length of the timing fluid metering event which is defined by the amount of time the timing fluid control valve 18 is held in the open position during the timing period. Likewise, the amount of injection fuel metered into metering chamber 102 is primarily dependent on the length of the injection fuel metering event which is defined by the amount of time the injection fuel control valve 20 remains in the open position during the metering period. Timing plunger 76 and fluid link 148 formed in timing chamber 86 force metering plunger 78 downwardly forcing fuel from metering chamber 102 into nozzle cavity 132 via transfer passage 126, fuel passage 128 and passage 130. When the pressure of fuel within nozzle cavity 132 exceeds a predetermined level tip valve element 136 moves outwardly to allow fuel to pass through the injector orifices 134 into the combustion chamber (not shown). When metering plunger 78 reaches its innermost position, annular groove 120 aligns with metering spill orifice 116 allowing fuel to spill from metering chamber 102 through axial passage 124 and radial passage 122 and back to the fuel supply via spill port 118. As a result, the fuel pressure in nozzle cavity 132 is also relieved via passages 126, 128, 130. When the fuel pressure in nozzle cavity 132 decreases to a level below the bias pressure of spring 138, spring 138 causes tip valve element 136 to move inwardly to close injector orifices 134 thus terminating injection.

By providing separate timing and metering circuits, controlled individually by a respective control valve, the metering system of the present invention can effectively and predictably control both fuel injection timing and metering at the same time during the metering, or outward, stroke of timing plunger 76 and metering plunger 78. In this manner, the period of time equal to the outward stroke of the plungers, which is defined by the cam profile, need not be divided into a metering period and a distinct separate timing period since both timing and metering may take place simultaneously. Therefore, by providing separate and distinct timing and metering circuits and respective control valves, the present invention maximizes the time periods available for both injection fuel metering and timing fluid metering for each injector.

Figure 4:
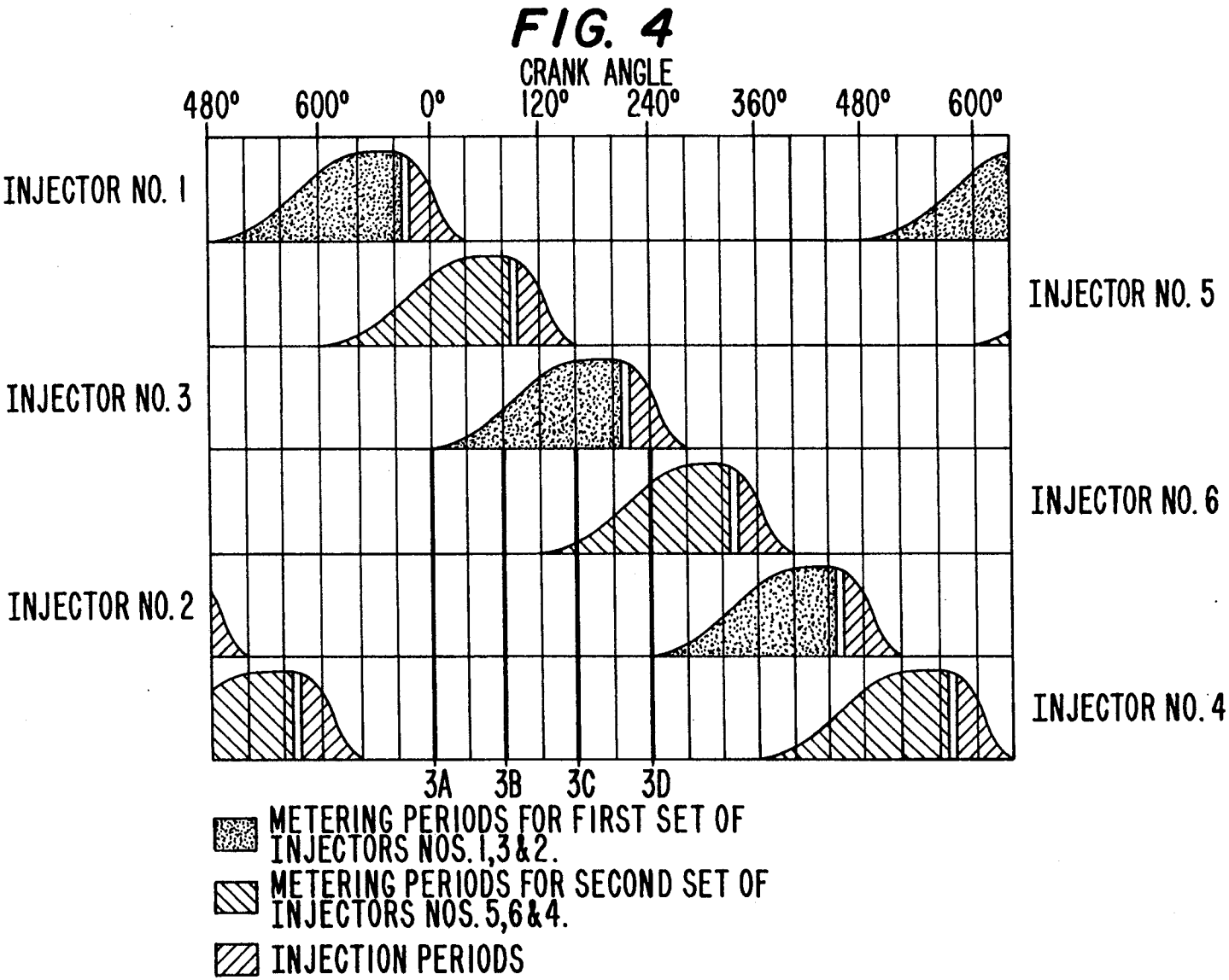
FIG. 4 is a graph showing the metering and injection periods of each injector of the FIG. 1 metering system throughout a complete cycle of the engine.

Moreover, the metering system of the present invention maximizes the time periods for metering timing fluid and fuel to each injector of a particular set of injectors by selectively grouping the injectors based on the order of the injection periods of the entire bank of injectors to allow the metering periods of a specific group to be spread throughout the total cycle time of the engine. As shown in FIGS. 3A–3D and FIG. 4, in a six-cylinder engine having one fuel injector for each cylinder, each unit fuel injector will inject fuel one time during a given engine cycle. In a conventional four-stroke diesel engine, each injector will inject fuel one time during two rotations of the crankshaft which equal 720° crank angle. As illustrated in FIG. 4, the injection events of injectors 1–6, corresponding to cylinders 1–6, occur in a specific sequential order throughout the 720° cycle of the engine. As previously mentioned, it is desirable to maximize the time period available for metering timing fluid and injection fuel into the appropriate chambers in order to increase the predictability and control of fuel injection throughout the engine's operating conditions. However, where only one control valve is used to control the metering of fluid to all six injectors, the metering periods cannot occur at the same time since the control valve must complete metering to each injector before operating to control metering to another injector. Therefore, the total engine cycle time period must be divided into six distinct separate metering periods. Referring to FIG. 4, in the present invention, the injectors are selectively arranged into two separately controlled sets of injectors such that the injection period of each injector of a specific set is followed by the injection period of an injector from a different set. Specifically, injectors 1, 2 and 3 are grouped into a first set of injectors 14 served by timing fluid control valve 18 and injection fuel control valve 20. Injectors 4, 5 and 6 are grouped into second set of unit injectors 16 served by control valves 22, 24. Since each set of injectors includes only three injectors instead of six, the total engine cycle time corresponding to 720° crank angle associated with each set is only divided into three metering periods. Moreover, the injectors are specifically arranged into sets 14, 16 according to the sequence of injection periods, which is 1, 5, 3, 6, 2 and 4, such that the injection periods alternate between the sets throughout the engine cycle. Therefore, the injectors from each group are placed in the injection mode in spaced periods throughout each cycle of the engine, e.g. injectors from other groups injecting in the period of time between each injection mode. As a result, each of the three metering and timing periods, associated with the three injectors of a given set, can be significantly increased by providing the appropriate cam profile. As shown in FIG. 4, the metering and timing periods associated with each set 14, 16 are extended throughout substantially the entire cycle time of the engine thereby maximizing the metering period of each injector while minimizing the operating demands on control valves 18, 20, 22, 24. Specifically, the metering and timing periods of each injector extend for a period of time corresponding to approximately 200° crank angle.

Although the metering periods of injectors from different sets occur at the same time, the metering periods of the injectors from a given set of injectors must occur throughout separate, distinct time intervals to allow the control valves to accurately deliver the proper amount of timing fluid and fuel to only one injector at any given time. Therefore, as shown in FIGS. 3A–3D and 4, each injector of first set 14 is operated by cam 142 such that, at any time during a given engine cycle, or in other words at any given crank angle of the engine, only one injector of first set 14 is positioned in a fuel receiving mode and a timing fluid receiving mode for receiving fuel from injection fuel control valve 20 and timing fluid control valve 18, respectively. Likewise, at any given time during the engine cycle, only one injector from second set 16 is positioned in a fuel receiving mode and a timing fluid receiving mode for receiving fuel from control valves 24, 22 respectively. As shown in FIG. 3A, injector 3 is just beginning to be placed in the timing fluid receiving mode and the injection fuel receiving mode which establish a timing period and a metering period respectively. Referring to FIG. 3B, when the control valves 18, 20 are opened to begin the timing and metering events for injector 3, injectors 1 and 2 are incapable of receiving timing fluid and fuel from common rail portions 42, 46. As shown in FIG. 3D, once control valves 18, 20 are closed and injector 3 is placed in the injection mode by cam 142, roller 144 and the plungers of injector 2 begin moving outwardly placing injector 2 in a fuel receiving mode thus beginning the metering period and timing period within which a fuel metering event and timing fluid metering event may occur, respectively. Meanwhile, injectors 1 and 3 are incapable of receiving timing fluid and fuel from common rail portions 42, 46. It should be understood that the second set of injectors 16 are being similarly operated by respective cams such that the metering periods of injectors 4, 5 and 6 are spread throughout substantially the entire cycle time of the engine without overlapping. Also, as can be seen from FIG. 4, the metering period of one injector from a given set of injectors may overlap with the injection period of a different injector from the same set of injectors since metered fuel and timing fluid has a significantly lower pressure than the timing fluid and injection fuel in the respective chambers during the injection stroke of the plungers.

Figure 5:
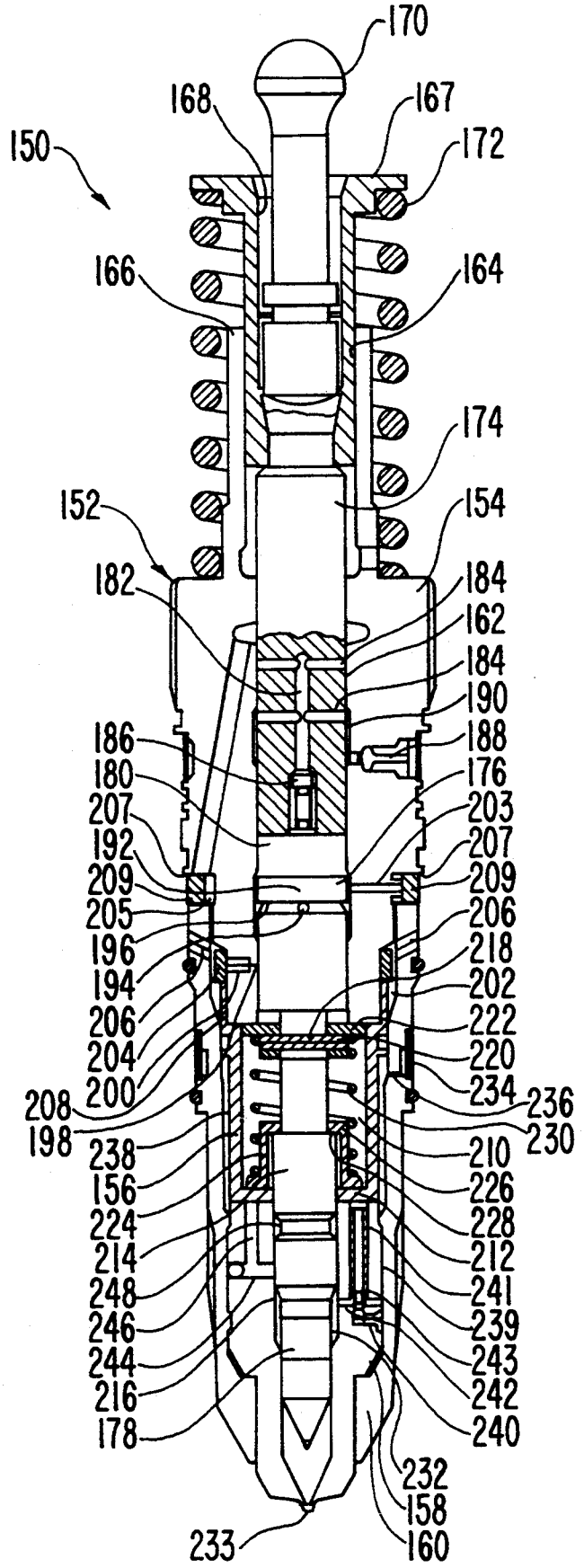
FIG. 5 is a cross-sectional view of an alternative embodiment of a unit injector which may be used in the metering system of FIG. 1 showing an open nozzle unit injector in a fuel receiving mode.

In an alternative embodiment of the present invention, as shown in FIG. 5, an open nozzle fuel injector may be used instead of the closed nozzle injector of FIG. 2. The open nozzle injector, indicated generally at 150, includes an injector body 152 formed from an outer barrel 154, an inner barrel 156, an injector cup 158 and a retainer 160. The inner barrel 156 and injector cup 158 are held in a compressive abutting relationship in the interior of retainer 160 by outer barrel 154. The outer end of retainer 160 contains internal threads for engaging corresponding external threads on the lower end of outer barrel 154 to permit the entire unit injector body 152 to be held together by simple relative rotation of retainer 160 with respect to outer barrel 154.

Outer barrel 154 includes a plunger cavity 162 which opens into a larger upper cavity 164 formed in an upper extension 166 of outer barrel 154. A coupling 167 is slidably mounted in upper cavity 164 and includes a cavity 168 for receiving a link 170. Coupling 167 and link 170 provide a reciprocable connection between the injector plungers and a driving cam (not shown) of the engine. A coupling spring 172 is positioned around extension 166 to provide an upward bias against coupling 167 to force link 170 against the injector drive train and corresponding cam (not shown).

Fuel injector 150 includes a timing plunger 174, intermediate plunger 176 and a metering plunger 178. Timing plunger 174 is positioned for reciprocable movement in plunger cavity 162 so as to abut the inner end of coupling 167. Intermediate plunger 176 is positioned for reciprocable movement in plunger cavity 162 between timing plunger 174 and metering plunger 178. The innermost end of timing plunger 174 together with the outermost end of intermediate plunger 176 forms a timing chamber 180 for receiving timing fluid from the particular timing fluid control valve associated with the set of injectors to which the injector belongs. Timing plunger 174 includes an axial passage 182 communicating with timing chamber 180 and extending outwardly to connect with a pair of diametrically extending passages 184 spaced longitudinally along axial passage 182 in timing plunger 174. A spring biased inlet check valve 186 positioned in axial passage 182 inwardly of passages 184 prevents the flow of timing fluid from timing chamber 180 through axial passage 182 and passages 184. Outer barrel 154 includes a timing fluid supply port 188 extending radially from plunger cavity 162 for supplying timing fluid to timing chamber 180. Outer barrel 154 also includes an annular recess 190 formed in the inner wall of outer barrel 154 between timing plunger 174 and supply port 188. Annular recess 190 extends axially along plunger cavity 162 a sufficient distance to insure that at least one of passages 184 communicate with annular recess 190 and, therefore, supply port 188 at all times during plunger movement.

Intermediate plunger 176 includes an axial passage 192 communicating with timing chamber 180 and extending to communicate with a radial passage 194. An annular groove 196 formed in intermediate plunger 176 communicates with radial passage 194. Outer barrel 154 includes a timing fluid spill orifice 198 and spill port 200 extending radially from plunger cavity 162 to an annular chamber 202 formed between outer barrel 154 and retainer 160. An annular spill ring 204 positioned around outer barrel 154 covers the opening of port 200 into chamber 202 and flexes radially outwardly at a predetermined pressure to allow timing fluid to spill from port 200 into chamber 202. A pair of drain ports 206 formed in retainer 160 adjacent annular chamber 202 directs timing fluid spilled into chamber 202 to drain. An annular spacer 208 positioned around the lower end of outer barrel 154 is used to position spill ring 204 in place over spill port 200. A drain passage 203 formed in outer barrel 154 extends radially outwardly from plunger cavity 162 adjacent timing chamber 180 to communicate with an annular groove 205 formed by the upper end of retainer 160 and an annular flange 207 formed on outer barrel 154. A circular ring valve 209 positioned in annular groove 205 around outer barrel 154 covers passage 203 preventing timing fluid flow from timing chamber 180 until a predetermined pressure is reached. The ring valve 209 flexes to open passage 203 during the injection event under certain engine conditions, such as low speed operation to limit the fluid pressure in timing chamber 180 and thus the peak injection pressure. The design and function of spill valve 204 and ring valve 209 are described in more detail in commonly owned U.S. application Ser. No. 898,818 which is hereby incorporated by reference.

Inner barrel 156 is generally cylindrically shaped to form a cavity 210 for receiving metering plunger 178. Inner barrel 156 includes a lower wall 212 having a central aperture 214 which allows metering plunger 178 to extend through cavity 210 inwardly into a bore 216 formed in injector cup 158. The outermost end of metering plunger 178 is positioned to contact free floating intermediate plunger 176 and includes a diametrically-extending hole 218 for receiving a cross pin 220. Cross pin 220 engages an outer spring keeper 222 to secure keeper 222 to the outermost end of metering plunger 178. An inner spring keeper 224 positioned inside cavity 210 includes an annular step 226 for abutment by an annular land 228 formed on metering plunger 178. A spring 230 is positioned in cavity 210 between outer spring keeper 222 and inner spring keeper 224 so as to bias outer spring keeper 222 into abutment with outer barrel 154 while also biasing metering plunger 178 outwardly.

A metering chamber 232 is formed in injector cup 158 between bore 216 and metering plunger 178. Fuel is supplied to metering chamber 232 via a fuel supply port 234 and supply orifice 236 formed in retainer 160 adjacent inner barrel 156. An annular channel 238 formed between inner barrel 156 and retainer 160 directs fuel from supply orifice 236 into an axially extending passage 239 formed between injector cup 158 and retainer 160. A radial supply passage 240 formed in injector cup 158 extends radially inward from passage 239 to communicate with the lower end of a longitudinal cavity 241 formed in injector cup 158 adjacent bore 216. A radial supply orifice 242 formed outwardly of passage 240 connects cavity 241 to bore 216. A spring loaded fueling check valve 243, positioned in longitudinal cavity 241 allows fuel above a predetermined pressure to flow from passage 240 through passage 242 into metering chamber 232. Check valve 243 also prevents combustion gas from entering supply passage 240 and interfering with the control of fuel metering. Moreover, at low operating speeds and loads, check valve 243 prevents cylinder pressure acting up through the metering chamber 232 from affecting the fuel metering since the supply fuel is not metered against cylinder pressure.

Injector cup 158 also includes a radially extending drain passage 244 and a longitudinally extending drain passage 246 communicating with passage 244. Passage 246 connects with a drain passage (not shown) which communicates with annular chamber 202. In this manner, timing fluid drained from timing chamber 180 into annular chamber 202 is directed through passage 246 into drain passage 244. This fluid is used to lubricate metering plunger 178 and to carry away any combustion gases leaking into metering chamber 232. An annular recess 248 formed in metering plunger 178 communicates with drain passage 244 when metering plunger 178 is in its innermost position to insure lubrication fuel is supplied between plunger 178 and bore 216.

The operation and advantages of the individual timing and injection fuel metering system of FIG. 1 using the open nozzle fuel injector of FIG. 5 as the injectors in each set 14, 16, are substantially the same as previously discussed with respect to the closed nozzle injector of FIG. 2 except for the operation of open nozzle unit injector 150 which will now be discussed in detail. FIG. 5 illustrates open nozzle unit injector 150 at the beginning of the injection mode with timing plunger 174 at its outermost position against coupling 167 and metering plunger 178 in its outermost position with outer spring keeper 222 held against outer barrel 154 by spring 230. As the cam (not shown) continues to rotate causing link 170 and coupling 167 to move inwardly against spring 172, timing plunger 174 is moved inwardly compressing the timing fluid in timing chamber 180 and ending the previous timing period. The compressed timing fluid in chamber 180 forms a solid hydraulic link between timing plunger 174 and intermediate plunger 176. Further movement of timing plunger 174 inwardly forces intermediate plunger 176 against the outermost portion of metering plunger 178 thereby moving metering plunger 178 inwardly against the spring pressure of spring 230. During the inward movement of metering plunger 178, fuel delivered to metering chamber 232 during the previous metering period is compressed and injected through injection orifices 233 formed in the lower end of cup 158. Injection will continue until the metering plunger 178 bottoms in injector cup 158 while, at the same time, annular groove 196 of intermediate plunger 176 aligns with spill orifice 198 allowing timing fluid to spill from timing chamber 180 through axial passage 192, radial passage 194, annular groove 196 into spill port 200. Spill ring 204 opens to allow timing fluid in spill port 200 to flow out of the injector through drain port 206. Timing plunger 174 continues to be forced inwardly by the rotation of the cam (not shown) forcing timing fluid out of chamber 180 until timing plunger 174 abuts intermediate plunger 176. At this point, plungers 174, 176 and 178 are mechanically held in an innermost position as link 170 rides on the outer base circle of the cam (not shown).

When link 170 reaches the ramp portion of the cam and begins moving outwardly, spring 230 will force metering plunger 178, intermediate plunger 176 and timing plunger 174 outwardly until upper spring keeper 222 abuts outer barrel 154 terminating the upward movement of metering plunger 178. Upward movement of metering plunger 178 opens supply orifice 242 marking the beginning of the metering period within which fuel may be metered into metering chamber 232. Also, upward movement of timing plunger 174 marks the beginning of the timing period during which timing fluid may be delivered to timing chamber 180 since at least one of passages 184 are open to annular recess 190 and spill orifice 198 is blocked by intermediate plunger 176. As previously discussed, the timing event during which timing fluid is delivered to timing chamber 180 is controlled by the opening time of the respective timing fluid control valves 18, 22. Likewise, the metering event during which fuel is delivered to metering chamber 232 is controlled by the opening time of injection fuel control valves 20, 24. The metering and timing events are completed before timing plunger 174 begins its inward movement which marks the end of both the metering and timing periods during which the metering and timing events must occur. Therefore, the end of the metering and timing periods are defined by the cam profile which controls the inward movement of link 170 and timing plunger 174.

Figure 6:
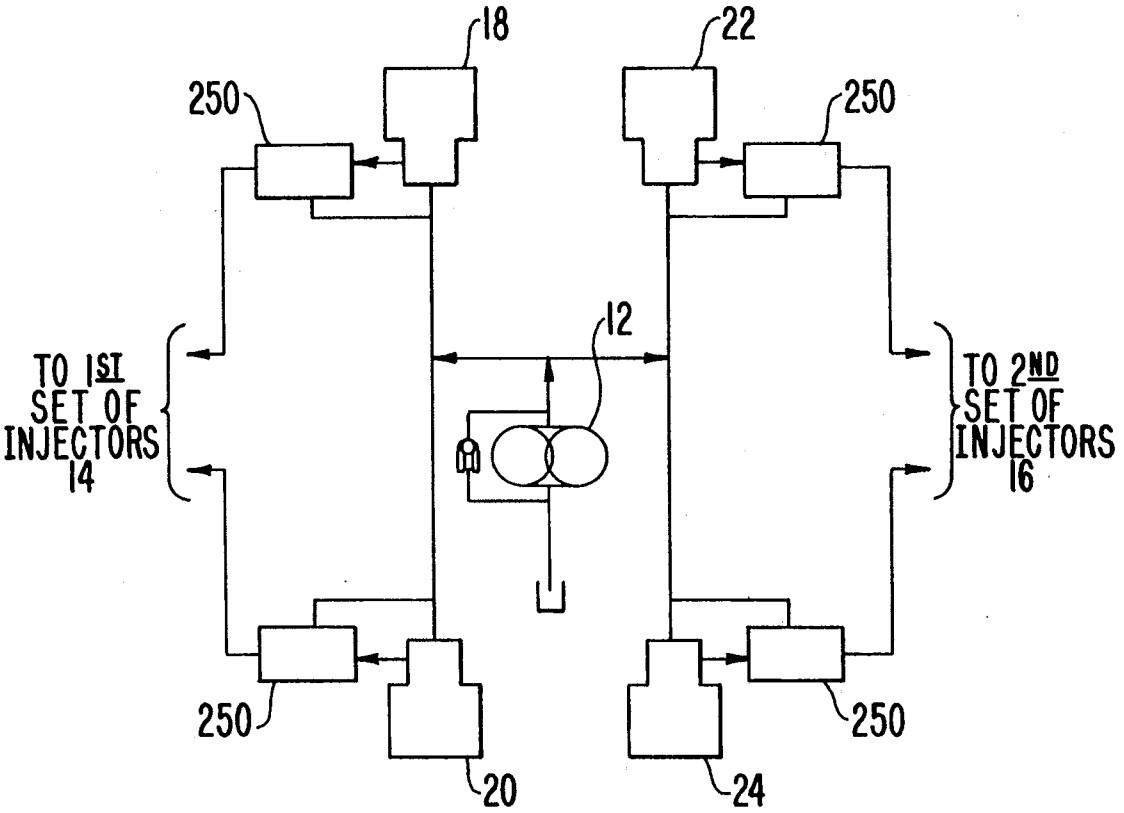
FIG. 6 is a second embodiment of the present invention including a flow control valve associated with each injection fuel and timing fluid control valve.

FIG. 6 illustrates another embodiment of the present invention which is the same as the embodiment of FIG. 1 except that a flow control valve 250 is positioned downstream of each control valve 18, 20, 22, 24 to provide a fixed flow rate during metering and timing events. Each flow control valve 250 receives fluid or fuel from a respective timing fluid or injection fuel control valve 18, 20, 22, 24 and insures that a fixed flow of timing fluid or fuel is delivered to a respective injector independent of fluid pressures upstream and downstream of the flow control valve 250.

Figure 7:
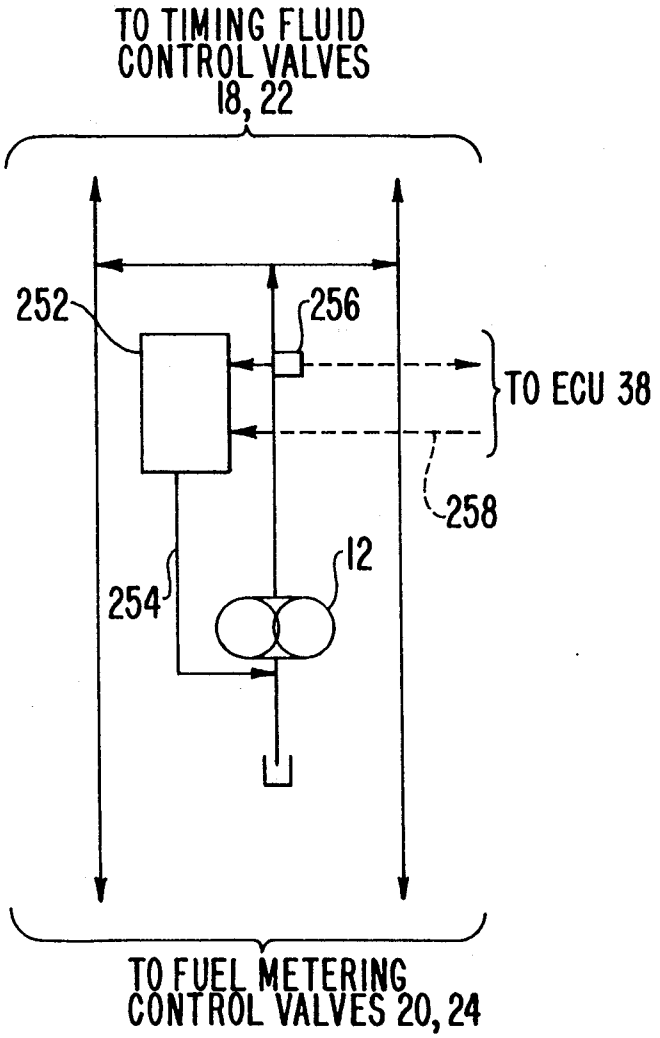
FIG. 7 is a third embodiment of the present invention including a pressure regulator positioned in a bypass circuit.

FIG. 7 represents another embodiment of the present invention which is the same as the embodiment shown in FIG. 1 except that a pressure regulator 252 is positioned in a bypass circuit 254 downstream of supply pump 12. Pressure regulator 252 controls the supply pressure to control valves 18, 20, 22, 24 by controlling the amount of fuel allowed to flow through bypass circuit 254 to the supply side of supply pump 12. Based on a pressure signal from a pressure sensor 256 sensing the fuel pressure downstream of supply pump 12 and other engine operating conditions, ECU 38 controls the pressure regulator 252 to vary the amount of bypassed fuel and thus the fuel supply pressure. Pressure regulator 252 is especially desirable during periods of low engine speed wherein a much smaller amount of fuel must be metered by the control valves. If the supply pressure were to remain constant, the control valves would be required to open and close extremely quickly to provide the proper amount of metered fuel. By decreasing the supply fuel pressure during periods of low speed operation, the operating requirements of the solenoid and its associated circuitry are decreased while maintaining effective and predictable control of fuel injection timing and metering.

Figure 8:
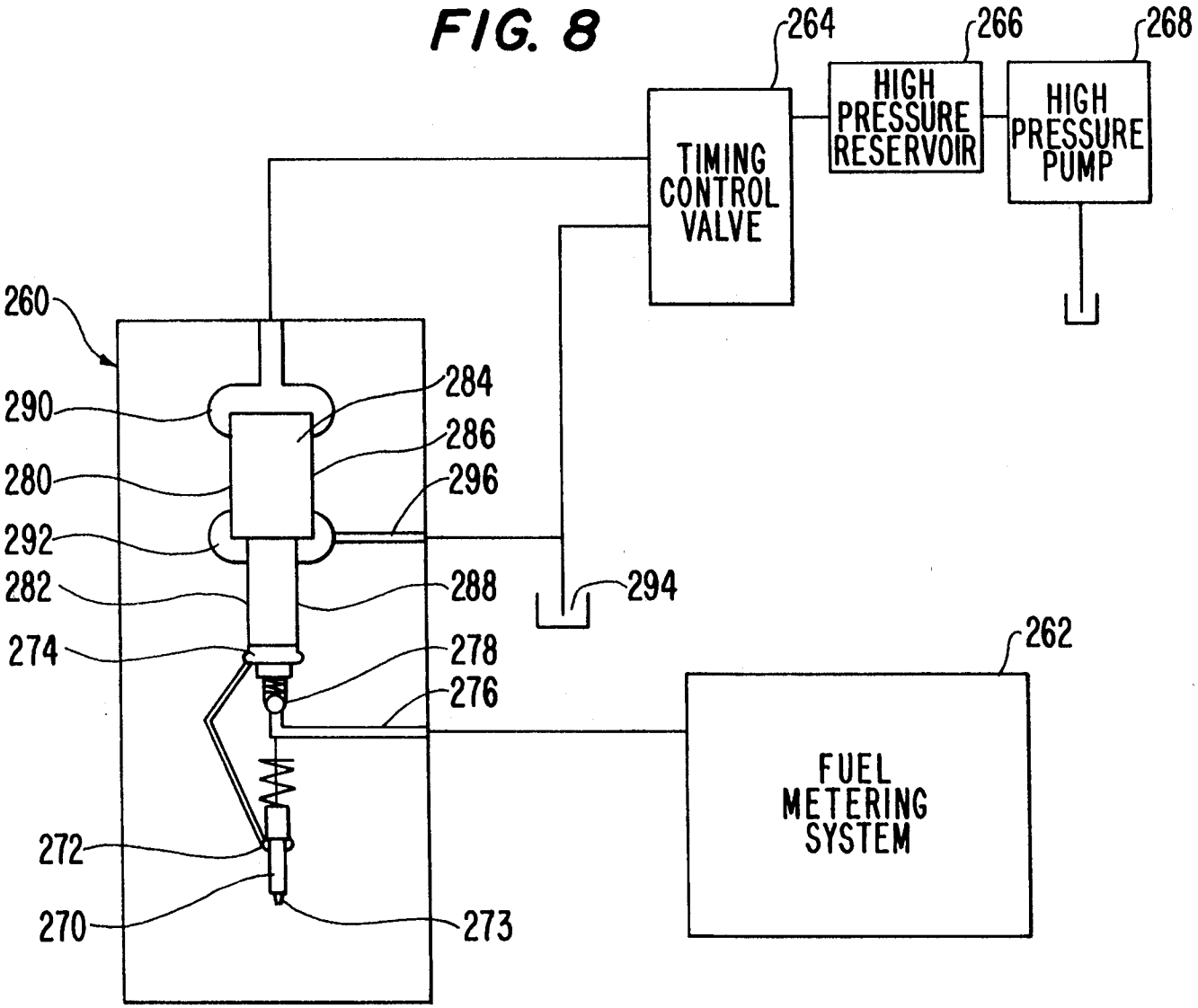
FIG. 8 is a fourth embodiment of the present invention including a separate timing control valve for each injector, a high pressure reservoir and a high pressure pump for supplying high pressure timing fluid to the injectors.

FIG. 8 represents yet another embodiment of the present invention which includes a fuel injector 260 supplied with fuel for injection by fuel metering system 262. Fuel metering system 262 is equivalent to the injection fuel control valves 20, 24, supply pump 12, ECU 38 and associated common rail portions 46, 48 illustrated in FIG. 1 and described hereinabove. Therefore, fuel metering system 262 also supplies fuel to two other fuel injectors (not shown) associated with a first set of injectors including injector 260 and to a second set of three fuel injectors (not shown). However, the timing fluid control portion of the metering system of FIG. 1 is replaced by a timing control valve 264, high pressure reservoir 266 and a high pressure pump 268. Each injector of each set of injectors includes its own timing control valve 264 receiving high pressure timing fluid from common reservoir 266 and common high pressure pump 268. Fuel injector 260 is of the closed nozzle type having the conventional tip valve element 270 spring biased against injector orifices 273 and positioned in a nozzle cavity 272 for receiving fuel from a metering chamber 274. Fuel is supplied from the fuel metering system 262 to metering chamber 274 via a supply passage 276 and inlet check valve 278.

The upper timing portion of injector 260 includes a large axial bore 280 and a smaller axial bore 282 positioned inwardly of and axially aligned with bore 280. A plunger 284 includes an upper section 286 mounted for reciprocal movement in bore 280 and a lower section 288 mounted for reciprocal movement in bore 282. The outermost end of upper section 286 is positioned in a cavity 290 adapted to receive timing fluid from control valve 264. The innermost end of upper section 286 is positioned in a second cavity 292 which is connected to a timing fluid drain 294 by a drain passage 296.

Timing fluid control valve 264 is a three-way solenoid valve which may be positioned to allow fuel to flow from reservoir 266 into cavity 290 to effect the inward movement of plunger 284 causing fuel injection at the appropriate time during each cycle of the engine. Control valve 264 may also be positioned to connect cavity 290 with drain 294 thus equalizing the pressure in cavities 290 and 292.

During operation, control valve 264 is positioned to allow high pressure timing fluid into cavity 290 thereby forcing plunger 284 inwardly preventing fuel from the fuel metering system from entering the metering chamber 274 until just before the time period for injection by injector 260. At this time, timing control valve 264 is positioned to block the flow of timing fluid from reservoir 266 while connecting cavity 290 to drain 294 thus starting the metering period. The injection fuel control valve associated with injector 260 may then be operated to allow fuel to pass through passage 276 into metering chamber 274. The pressure of the supply fuel entering metering chamber 274 forces plunger 284 outwardly until the associated fuel control valve closes thus terminating the metering event. Timing control valve 264 may then be positioned to allow high pressure timing fluid from reservoir 266 to flow to cavity 290. The high pressure of the timing fluid acting on the end of plunger 284 positioned in cavity 290 forces plunger 284 inwardly. Lower section 288 of plunger 284 compresses fuel in metering chamber 274 and, consequently, nozzle cavity 272 until the fuel pressure in nozzle 272 exceeds the spring bias pressure of tip valve element 270 causing element 270 to move outwardly to allow fuel to pass through the injector orifices 273 in the combustion chamber (not shown). When injection is complete, timing control valve 264 is returned to the position blocking the flow of timing fluid from reservoir 266 and connecting cavity 290 to drain 294 thus positioning the injector for fuel metering during the next cycle of the engine.

Figure 9:
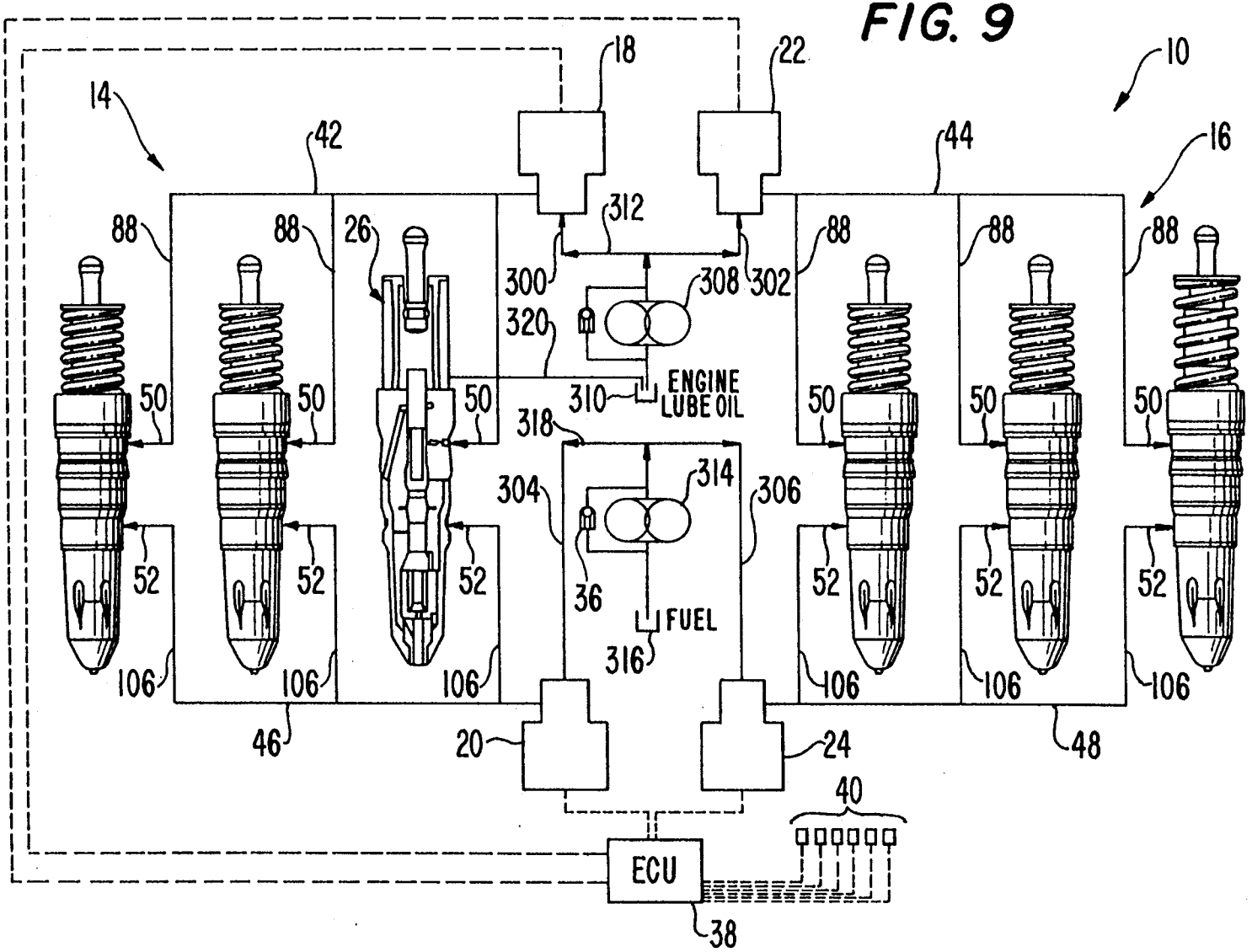
FIG. 9 is a fifth embodiment of the present invention which uses lube oil as the timing fluid supplied through timing fluid supply paths which are fluidically separate from the fuel metering supply paths.

FIG. 9 illustrates a further embodiment of the present invention which is the same as the embodiment shown in FIG. 1 except that the timing fluid supply paths 300 and 302 are fluidically separate from the fuel supply paths 304 and 306 to allow lubrication oil to the used as the timing fluid. An engine lube oil pump 308, which is preferably a gear pump, draws fuel from a reservoir 310 and directs it through a supply passage 312 connected to timing fluid supply paths 300, 302. A separate fuel supply pump 314 draws fuel from a reservoir 316 for delivery to the injectors 14, 16 via a supply passage 318, fuel supply paths 304, 306, common rail portions 46, 48 and fuel metering circuits 52 as governed by the position of injection control valves 20, 24 as discussed hereinabove with respect to the embodiment of FIG. 1. The delivery of lube oil timing fluid to the injectors 14, 16 via common rails 42, 44 and timing circuits 50 is also controlled by the operation of timing fluid control valves 18, 22 as discussed hereinabove with respect to FIG. 1. Lube oil spilling from the timing chamber of each injector 26 is returned to the engine lube oil reservoir 310 via a drain passage 320.

The use of lubrication fluid as a timing fluid in a lubrication timing fluid circuit completely separate from the fuel metering circuit serves several important functions. First, by using lubrication fluid instead of fuel as the timing fluid, the fuel supply demanded by each injector on a cycle by cycle basis is reduced significantly which reduces the amount of hot fuel returned to the fuel supply tank downstream of the fuel drain. As a result, the fuel temperature in the fuel supply tank is reduced significantly minimizing undesired fuel evaporation and avoiding the need for expensive fuel coolers.

Referring to FIGS. 2 and 5, the lubrication fluid provides improved lubrication of the timing plunger 76, 174 as it reciprocates in the plunger cavity 66, 162. Third, a leakoff passage or groove 83, 85 is not needed between the timing chamber 86, 180 and upper cavity 68, 164 because the lubrication fluid that escapes from the outer end of the injector body is simply released into the rocker housing of the engine where engine lubrication oil already exists. Therefore, any leak-by lubrication fluid can likewise be used to lubricate coupling 72, 167 and any other linkage in the rocker housing. Fourth, the lubrication fluid functions to cool the fuel injector internals as it flows through the lubrication fluid timing circuit during each cycle.

Industrial Applicability

While the individual timing and injection fuel metering system of the present invention is most useful in a compression ignition internal combustion engine, it can be used in any combustion engine of any vehicle or industrial equipment in which accurate control and variation of the timing of injection and the metering of the proper quantity of fuel is essential.

We claim:

1. A metering system for controlling the amount of fuel supplied to the combustion chambers of a multi-cylinder internal combustion engine, comprising:

a fluid supply means for supplying fuel at low supply pressure, said fluid supply means including first and second fuel supply paths;

a first set of unit injectors for receiving fuel from said fluid supply means at the low supply pressure and for injecting the fuel at relatively high pressure into respective combustion chambers of the engine, each injector of said first set adapted to be placed in a fuel receiving mode for receiving fuel from said fluid supply means, only one unit injector from said first set of unit injectors being placed in said fuel receiving mode at any given time;

a first electromagnetic fuel control valve positioned in said first fuel supply path between said fluid supply means and said first set of unit injectors for controlling the flow of fuel to said first set of unit injectors;

a second set of unit injectors for receiving fuel from said fluid supply means at the low pressure and for injecting the fuel at relatively high pressure into respective combustion chambers of the engine, each injector of said second set adapted to be placed in a fuel receiving mode for receiving fuel from said fluid supply means, only one unit injector from said second set of unit injectors being placed in said fuel receiving mode at any given time; and a second electromagnetic fuel control valve positioned in said second fuel supply path between said fluid supply means and said second set of unit injectors for controlling the flow of fuel to said second set of unit injectors.

2. The metering system of claim 1, wherein said fluid supply means includes first and second timing fluid supply paths for supplying timing fluid to said first and said second set of unit injectors, respectively, each unit injector of said first and said second set of unit injectors adapted to receive timing fluid from said fluid supply means for controlling the timing of injection, further including a first electromagnetic timing fluid control valve positioned in said first timing fluid supply path between said fluid supply means and said first set of unit injectors for controlling the flow of timing fluid to said first set of unit injectors, and a second electromagnetic timing fluid control valve positioned in said second timing fluid supply path between said fluid supply means and said second set of unit injectors for controlling the flow of timing fluid to said second set of unit injectors, wherein at any given time during the operation of the unit injectors only one unit injector from each of said first and said second set of unit injectors is in a timing fluid receiving mode for receiving timing fluid from said fluid supply means.

3. The metering system of claim 2, wherein said one unit injector is capable of being in said fuel receiving mode and said timing fluid receiving mode at the same time.

4. The metering system of claim 2, wherein each unit injector includes an injector body containing an injector cavity, a fluid timing circuit communicating with one of said first and said second timing fluid supply paths, and a fuel metering circuit communicating with one of said first and said second fuel supply paths, said fluid timing circuit and said fuel metering circuit communicating with said injector cavity, and an injection orifice formed in one end of said injector body and further including a plunger means mounted for reciprocal movement within said injector cavity, said plunger means comprising inner and outer plunger sections, a variable volume timing chamber being formed in said injector cavity between said inner and outer plunger sections and a variable volume fuel metering chamber being formed in said injector cavity between said inner plunger section and said injection orifice and wherein said plunger means is operable to be placed in said fuel receiving mode establishing a metering period during which fuel may flow through said metering circuit into said metering chamber, is operable to be placed in said timing fluid receiving mode establishing a timing period during which timing fluid may flow through said fluid timing circuit into said timing chamber, and is operable to be placed in an injection mode in which fluid flow through both circuits to both of said chambers is blocked thereby for producing injection of the fuel in said metering chamber through said injection orifice.

5. The metering system of claim 4, wherein at least a portion of said metering period of each unit injector occurs during said timing period of the same unit injector.

6. The metering system of claim 4, wherein said first and said second electromagnetic fuel control valves are each movable between an open position wherein fuel may flow therethrough to said metering chamber of a unit injector of said first set of unit fuel injectors and said second set of unit fuel injectors, respectively, during said metering period and a closed position wherein fuel is blocked from flowing therethrough to said metering chamber, and wherein said first and said second electromagnetic timing fluid control valves are each movable between an open position wherein timing fluid may flow therethrough to said timing chamber of a unit injector of said first set of unit fuel injectors and said second set of unit fuel injectors, respectively, during said timing period and a closed position wherein fluid is blocked from flowing therethrough to said timing chamber.

7. The metering system of claim 6, wherein each of said first and said second electromagnetic fuel control valves and each of said first and said second electromagnetic timing fluid control valves is movable from said closed position to said open position and from said open position to said closed position within said metering period and said timing period, respectively, to define a fuel metering event and a timing fluid metering event, respectively.

8. The metering system of claim 7, wherein said plunger means is operable to move through periodic injection Strokes in which said plunger means moves inwardly in said injector cavity toward said injection orifice for each cycle of the engine causing fuel to be expelled from said injector cavity through said injection orifice to the combustion chamber, said fuel metering event and said timing fluid metering event occurring only between said periodic injection strokes.

9. The metering system of claim 7, wherein said plunger means is operable to move through a metering stroke in which said plunger means moves outwardly in said injector cavity away from said injection orifice, said fuel metering event and said timing fluid metering event occurring only during said metering stroke.

10. The metering system of claim 1, wherein each unit injector of said first and said second set of unit injectors includes an injector body containing an injector cavity, a fluid timing circuit for receiving timing fluid from said fluid supply means, a fuel metering circuit communicating with one of said first and second fuel supply paths, a plunger means mounted for reciprocal movement within said injector cavity and an injection orifice formed in said injector body at one end of said injector cavity, a variable volume metering chamber being formed in said injector cavity adjacent a first end of said plunger means between said plunger means and said injection orifice and a variable volume timing chamber being formed in said injector cavity adjacent a second end of said plunger means opposite said first face, said timing chamber of each injector adapted to receive timing fluid from said fluid supply means, further including an electromagnetic timing fluid control valve positioned in said fluid timing circuit between said timing chamber and said fluid supply means for controlling the flow of timing fluid to said timing chamber, wherein said electromagnetic timing fluid control valve is movable between an open position wherein timing fluid may flow therethrough to said timing chamber and a drain position wherein timing fluid is drained therethrough from said timing chamber to define a timing event during which the timing fluid at a predetermined pressure forces said plunger means toward said metering chamber for producing injection of the fuel in said metering chamber through said injection orifice.

11. The metering system of claim 10, wherein the timing fluid acts on said second end of said plunger means to force said plunger means toward said metering chamber, said second end having an effective cross-sectional area greater than the effective cross-sectional area of said first end of said plunger means.

12. The metering system of claim 4, wherein said fuel metering circuit includes a fuel supply port formed in said injector body and a spring-loaded check valve positioned upstream of said supply port for permitting fuel to flow into said metering chamber during said metering period and for preventing the flow of fuel from said metering chamber during the period of injector operation when the metered fuel is injected.

13. The metering system of claim 12, wherein said inner plunger section reciprocates adjacent to said injection orifice and said metering chamber is positioned adjacent said injection orifice.

14. The metering system of claim 2, wherein said fluid supply means supplies timing fluid to said first and said second timing fluid supply paths at a substantially constant pressure and supplies fuel to said first and said second fuel supply paths at a substantially constant pressure.

15. The metering system of claim 2, wherein said fluid supply means includes a fuel pump for providing fuel to each of said first and said second fuel supply paths and to each of said first and said second timing fluid supply paths.

16. The metering system of claim 15, wherein said fuel pump includes a pressure regulator for varying the fuel supply pressure based on engine operating conditions.

17. The metering system of claim 15, further including at least one flow control valve positioned downstream of said fuel pump for providing a fixed fuel flow rate independent of fuel pressures upstream and downstream of said at least one flow control valve.

18. The metering system of claim 17, wherein said at least one flow control valve includes four flow control valves, each of said four flow Control valves positioned adjacent one of said electromagnetic valves.

19. The metering system of claim 1, wherein each injector of said first and said second set of injectors is adapted to be placed in a fuel injection mode for producing injection of the fuel into respective combustion chambers of the engine, said injection mode of each injector in said first set of injectors occurring after the injection mode of an injector of said second set of injectors.

20. The metering system of claim 2, wherein said first and second timing fluid supply paths are fluidically separate from said first and second fuel supply paths.

21. The metering system of claim 20, wherein said fluid supply means includes a lube oil supply pump for supplying lube oil to said timing fluid supply paths and a fuel supply pump for supplying fuel to said first and second fuel supply paths.

22. A metering system for metering and timing of fuel injection into the combustion chambers of a multi-cylinder internal combustion engine, comprising:

a fluid supply means for supplying fuel and timing fluid at a low supply pressure, said fluid supply means including a timing fluid common rail and a fuel common rail;

one or more unit injectors positioned adjacent said common rails for receiving fuel at the low supply pressure and for injecting the fuel at relatively high pressure into respective combustion chambers of the engine, each of said one or more injectors including an injector body containing an injector cavity, a fluid timing circuit communicating with said timing fluid common rail, a fuel metering circuit communicating with said fuel common rail, and an injection orifice formed in one end of said injector body and further including a plunger means mounted for reciprocal movement in said injector cavity, said plunger means including inner and outer plunger sections, a variable volume timing chamber being formed in said injector cavity between said inner and outer plunger sections and a variable volume fuel metering chamber being formed in said injector cavity between said inner plunger section and an end of the injector cavity;

an electromagnetic timing fluid control valve positioned in said timing fluid common rail for controlling the flow of fuel to said timing chamber, said electromagnetic timing fluid control valve being movable between an open position wherein timing fluid may flow therethrough to said timing chamber and a closed position wherein fluid is blocked from flowing therethrough to said timing chamber; and an electromagnetic fuel control valve positioned in said fuel common rail for controlling the flow of fuel to said metering chamber, said electromagnetic fuel control valve being movable between an open position wherein fuel may flow therethrough to said metering chamber and a closed position wherein fuel is blocked from flowing therethrough to said metering chamber, wherein said electromagnetic fuel control valve and said electromagnetic timing fluid control valve are each movable from said closed position to said open position and from said open position to said closed position to define a fuel metering event and a timing fluid metering event, respectively, during which a predetermined quantity of fuel and timing fluid, respectively, are metered into said metering chamber and said timing chamber, respectively.

23. The metering system of claim 22, wherein said plunger means is operable to be placed in a fuel receiving mode establishing a metering period during which fuel may flow through said metering circuit into said metering chamber, said plunger means operable to be placed in a timing fluid receiving mode establishing a timing period during which timing fluid may flow through said timing fluid common rail into said timing chamber, and said plunger means operable to be placed in an injection mode in which fluid flow through both said circuits to both of said chambers is blocked thereby for producing injection of the fuel in said metering chamber through said injection orifice.

24. The metering system of claim 23, wherein at least a portion of said metering period of each of said one or more injectors occurs during said timing period of the same injector.

25. The metering system of claim 24, wherein said plunger means is operable to move through periodic injection strokes in which said plunger means moves inwardly in said injector cavity toward the said injection orifice for each cycle of the engine causing fuel to be expelled from said injector cavity through said injection orifice to the combustion chamber, said fuel metering event and said timing fluid metering event occurring only between said periodic injection strokes.

26. The metering system of claim 24, wherein said plunger means is operable to move through a metering stroke in which said plunger means moves outwardly in said injector cavity away from said injection orifice, said fuel metering event and said timing fluid metering event occurring only during said metering stroke.

27. The metering system of claim 22, wherein said fluid supply means includes a fuel supply pump for supplying both fuel and a timing fluid to said one or more injectors.

28. The metering system of claim 22, wherein said electromagnetic timing fluid control valve is movable between an open position wherein timing fluid may flow therethrough to said timing chamber and a closed position wherein fluid is blocked from flowing therethrough to said timing chamber to define a timing event during which the timing fluid at a predetermined pressure forces said plunger means toward said metering chamber for producing injection of the fuel in said metering chamber through said injection orifice.

29. The metering system of claim 22, wherein said fuel metering circuit each includes a fuel supply port formed in said injector body and a spring-loaded check valve positioned upstream of said supply port for permitting fuel into said metering chamber during said metering period and for preventing the flow of fuel from said metering chamber during the period of injector operation when the metered fuel is injected.

30. The metering system of claim 29, wherein said inner plunger section reciprocates adjacent to said injection orifice and said metering chamber is positioned adjacent said injection orifice.

31. The metering system of claim 27, wherein said fluid supply means supplies timing fluid to said timing fluid common rail at a substantially constant pressure and supplies fuel to said fuel common rail at a substantially constant pressure.

32. The metering system of claim 27, wherein said fuel pump includes a pressure regulator for varying the fuel supply pressure based on engine operating conditions.

33. The metering system of claim 27, further including at least one flow control valve positioned downstream of said fuel pump for providing a fixed fuel flow rate independent of upstream and downstream fuel pressures.

34. The metering system of claim 33, wherein said at least one flow control valve includes two flow control valves, each of said two flow control valves positioned adjacent one of said electromagnetic valves.

35. The metering system of claim 22, wherein said timing fluid common rail and said fluid timing circuit is fluidically separate from said fuel common rail and said fuel metering circuit.

36. The metering system of claim 35, wherein said fluid supply means includes a lube oil supply pump for supplying lube oil to said timing fluid common rail and a fuel supply pump for supplying fuel to said fuel common rail.

* * * * *